US009968861B2

(12) United States Patent
Brown, Sr.

(10) Patent No.: US 9,968,861 B2
(45) Date of Patent: May 15, 2018

(54) DETACHABLE MULTI-FUNCTIONAL HOUSING COMPARTMENT INSERT WITH ATTACHABLE ACCESSORY TEMPLATES

(71) Applicant: Dolhman Brown, Sr., Harvey, LA (US)

(72) Inventor: Dolhman Brown, Sr., Harvey, LA (US)

( * ) Notice: Subject to any disclaimer, the term of this patent is extended or adjusted under 35 U.S.C. 154(b) by 0 days. days.

(21) Appl. No.: 15/055,646

(22) Filed: Feb. 29, 2016

(65) Prior Publication Data

US 2017/0246546 A1 Aug. 31, 2017

(51) Int. Cl.

| | |
|---|---|
| ***A63H 3/00*** | (2006.01) |
| ***A63H 33/00*** | (2006.01) |
| ***A63H 3/02*** | (2006.01) |
| ***A63H 3/06*** | (2006.01) |
| ***A63H 33/42*** | (2006.01) |
| ***A63H 3/52*** | (2006.01) |

(52) U.S. Cl.

CPC ..... *A63H 3/005* (2013.01); *A63H 3/003* (2013.01); *A63H 3/02* (2013.01); *A63H 3/06* (2013.01); *A63H 3/52* (2013.01); *A63H 33/004* (2013.01); *A63H 33/42* (2013.01)

(58) Field of Classification Search

CPC ..... A63H 3/00; A63H 3/003; A63H 3/005; A63H 3/02; A63H 3/06; A63H 33/00; A63H 33/004; B65D 81/365

See application file for complete search history.

(56) References Cited

U.S. PATENT DOCUMENTS

| | | | | | |
|---|---|---|---|---|---|
| 4,206,567 | A * | 6/1980 | Cieslak | A63H 3/005 | 312/204 |
| 4,438,579 | A * | 3/1984 | Engel | G09F 19/12 | 40/661 |
| 4,624,649 | A * | 11/1986 | Blocker | A63H 3/52 | 190/2 |
| 5,152,710 | A * | 10/1992 | Montgomery | A63H 3/52 | 206/427 |

(Continued)

*Primary Examiner* — Gene Kim
*Assistant Examiner* — Alyssa Hylinski
(74) *Attorney, Agent, or Firm* — Terry M. Sanks, Esq.; Lisa D. Velez; Beusse Wolter Sanks & Maire, PLLC

(57) ABSTRACT

A novelty toy body, inflatable body, mascot or costume body, configured for housing a detachable multi-functional housing compartment, the detachable multi-functional housing compartment insert assembly having a general compartment cavity comprising a plurality of separable fasteners for receiving a plurality of Attachable Accessory Templates. The Attachable Accessory Templates being used to for different settings involving such as but not limited to; Global Education Initiatives, Sand Play Therapy, Recreation Therapy, Activity Based Learning using Electronic devices, social skill activities, Teddy Bear Therapy, adult or children counseling, Art Therapy, using transitional objects in a therapeutic setting, behavioral hospitals, Individuals with special needs, Individualized Education Program (IEP), furthermore comprising programs such as, Curriculum Based Programs, Head Start, Preschool Programs, Child Care Programs, After School Programs, Private or Public Schools, Home Schools, Daycares, to help improve one's (Continued)

hand-eye coordination, fine or gross motor skills, pattern recognition, letters, numbers, reading or writing skills.

17 Claims, 12 Drawing Sheets

(56) References Cited

U.S. PATENT DOCUMENTS

| | | | | |
|---|---|---|---|---|
| 5,564,960 | A * | 10/1996 | Underhill, Jr. | A45C 1/12 446/482 |
| 5,779,570 | A * | 7/1998 | Bear | A63B 63/08 273/401 |
| 8,152,587 | B1 * | 4/2012 | Brown | A63H 3/02 206/216 |
| 2002/0022431 | A1 * | 2/2002 | Schneider | A63H 3/005 446/73 |
| 2004/0077276 | A1 * | 4/2004 | Fondin | A63H 3/003 446/369 |

* cited by examiner

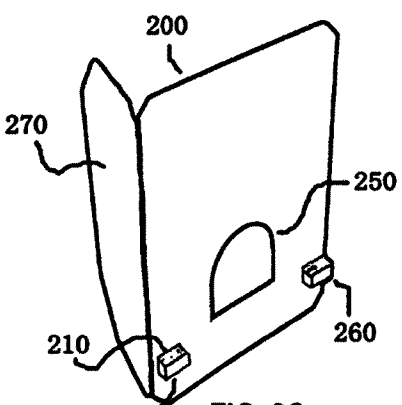
FIG. 2A
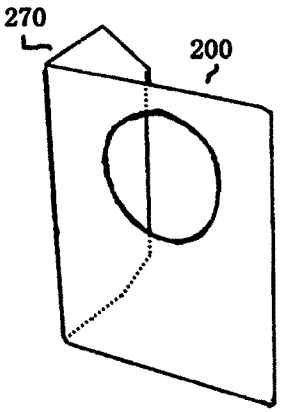
FIG. 2B
FIG. 2C
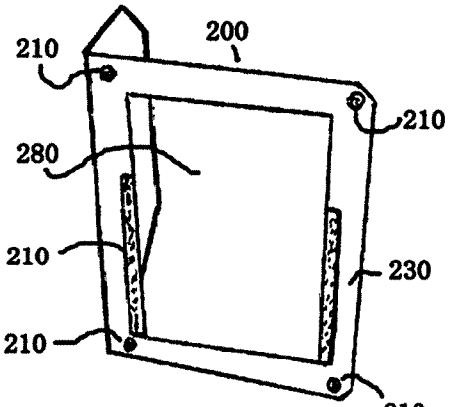
FIG. 2D
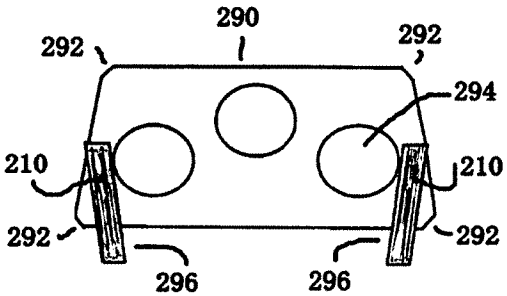
FIG. 2E

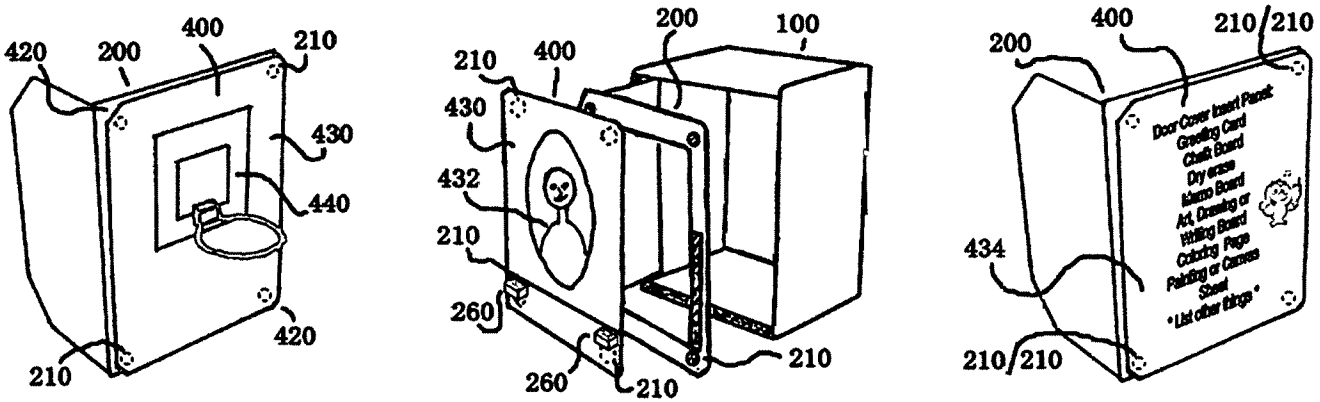
FIG. 4A
FIG. 4B
FIG. 4C
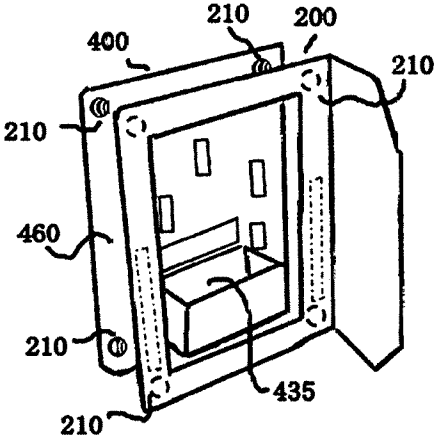
FIG. 4E
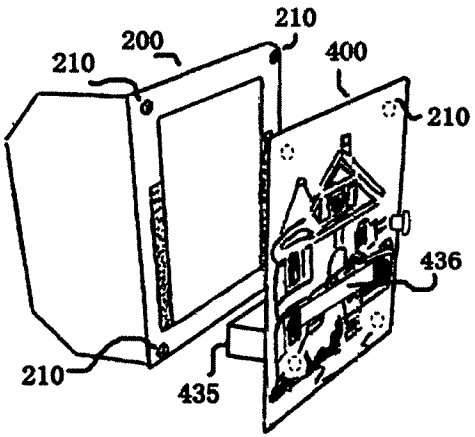
FIG. 4D 1100
210/210
850
830
830

1100
180
600
210
800
850
840

750
210
210
800
210
700
850
870
210
210

210
210
800
210
830
850
830

500
210
844
700
210/210
800
210/210
850
890

DETACHABLE MULTI-FUNCTIONAL HOUSING COMPARTMENT INSERT WITH ATTACHABLE ACCESSORY TEMPLATES

This application claims priority benefit of provisional application Ser. No. 62/126,562 filed on Feb. 28, 2015, incorporated herein by reference as if set forth in full below.

BACKGROUND OF THE INVENTION

I. Field of the Invention

The present invention is an improvement relating to prior granted application Ser. No. 12/653,439, U.S. Pat. No. 8,152,587. The present invention also relates generally to novelty toys, mascot or costume suits or inflatable toys and more specifically it relates to a novelty toy body, inflatable body, mascot or costume body having a detachable multi-functional housing compartment insert assembly comprising a plurality of attachable accessory templates connecting to its body.

II. Description of the Related Art

It can be appreciated that novelty toys, inflatables, mascot or costumes have been in use for years. Typically, inflatable or plush toys, mascots or costumes are comprised of different types of fillings in their body cavity with a variety of functions. Some of these functioning inflatable or plush toys, mascots, or costumes store within them air, water, sand, foam padding, voice or sound modules with press-buttons stored or located somewhere throughout the body to activate the voice. Other novelty toys, inflatables, mascot or costumes may consist of such as, without limitation stored within a chamber of the body, or a recording apparatus stored inside to repeat ones voice or play prerecorded stories, songs or a voice coming from a clown, teddy bear, mascot or costume characters such as, without limitation to Bozo The Clown, Mickey Mouse, Bugs Bunny, Sesame Street Characters, Barney, or SpongeBob, School, Charity, Party, Corporate, Carnival Activities, Holiday, Fundraiser or Sports Mascots just to name a few. Whereas, a variety of these novelty toys, inflatables, mascot or costumes have been used for holiday settings, delivery services, party or activity planning and special occasions.

Some of these novelty toys, inflatables, mascot or costumes are being used by licensed or certified professionals to help engage individuals in therapy. These professional individuals are such as, but not limited to the following, Developmental Psychologist, Mental Health Or Substance Abuse Social Workers, Child And Family Social Workers, School Social Worker Or Counselors, Licensed Therapist, Licensed Counselor, Licensed Clinical Social Worker, Licensed Social Worker, Licensed Professional Counselor, Medical Social Worker, Play Therapists, Expressive or Creative Arts Therapist, Sand Tray Therapist and Recreational Therapists and Sensory Integration Therapy—Pediatric Occupational Therapy just to name a few.

These traditional or conventional novelty toys, inflatables, mascot or costumes have also been used to engage individuals in Educational, Children's or Behavioral hospital settings through the use of Activities for Child Development which includes Teddy Bear Therapy, Art Therapy, Pretend Play Therapy, Expressive Arts Therapy, Art based Teaching, Educational Therapy, Recreation Therapy, Imaginative Play, Inquiry Based Learning, Connected Learning, Therapeutic Recreation and/or Project Based Learning (PBL) activities, just to name a few.

Furthermore, these traditional or conventional novelty toys, inflatables, mascot or costumes have also been used to engage individuals including those who are Developmentally Delayed or with special needs who need an Individualized Education Program (IEP) or Curriculum designed to meet their individual needs. These programs or schools are such as, but not limited to the following, Curriculum Based Programs, S.T.E.A.M. Program, Early Childhood Education, Head Start, Preschool Programs, Child Care Programs, After School Programs, Private or Public Schools, S.T.E.M. Program, Charter or Magnet Schools, Independent or Parochial Schools, Home Schools and Daycares, just to name a few.

However, traditional or conventional novelty toys, inflatables, mascot or costumes do not have a UNIVERSAL detachable multi-functional housing compartment insert assembly with a plurality of Attachable Accessory Templates that are placed, concealed, stored, secured or housed in one or the other's body cavity for therapeutic settings such as Teddy Bear Therapy, presentation arts and crafts, games or activities to potentially help improve one's hand-eye coordination, fine or gross motor skills, pattern recognition, shapes, spatial relationships, socialization, letters, numbers, reading or writing skills.

Furthermore, the conventional novelty toys, inflatables, mascot or costumes do not have a universal Detachable Multi-Functional Housing Compartment Insert Assembly with a plurality of Attachable Accessory Templates to hold, package, conceal or store inside of their compartment such as but not limited to Gift Basket novelty or gift items, Social Skills or Learning Activities, Inquiry Based Learning, Connected Learning, Play Therapy Games, figurines, dolls or dollhouse accessories, Plants, Terrariums, Diorama, Sandbox or Sand Tray, Greenhouse or Garden, Urns, Reptile Habitat or Insect Lore, Hermit Crab or Fish Tank Enclosures, Boxed Chocolates or Candy, bouquets, shadow boxes, Flowers, Jewelry, Picture Frame, Candles, Travel Sized Items, Garments or Clothing Items, Trinkets or Figurines, Collector's Items, Electronic Devices (e.g., Tablets, Smartphones, Android Devices, Mobile technology, Kindle Fire, Nook, iPad, Samsung, or Windows Phone), Inspirational Gifts, Graduation Items, Wedding or Anniversary Gifts, Diaries, Journals and/or Newborn Baby Accessories just to name a few.

Furthermore, the conventional novelty toys, inflatables, mascot or costumes do not have an Attachable Door Cover Inserts that can be inserted and/or attached inside the detachable multi-functional housing compartment to hold, grasp or affix an assortment of different Attachable Door Cover Insert Panel Accessories that can be used in diverse ways to its outer or inner surface, such as put not limited to greeting cards, chalk, memo or drawing board, arts, games, crafts, plant or flower stand holder, box or basket designs.

Neither do they have an optional Attachable Door Cover Screen Protector Insert Panel used to see and operate Electronic Devices such as a Tablet, Smartphone, Android, Mobile technology, Kindle Fire, Nook, iPad or Samsung device, while aiding to protect them from someone scratching or touching the original surface of the electronic device. Nor an Attachable Door Cover Transparency Insert Panel that can be used to print translucent arts, graphics, games, paintings Nor an Attachable Door Cover Transparency film Insert Panel that can be used to print transparent arts, graphics, games, paintings or designs.

Furthermore, novelty toys, inflatables, mascot or costumes do not have an Attachable Door Cover Insert Panel for exterior games, baskets, arts and craft accessories to the Attachable Cover Insert that is used to couple, connect, attach, secure, affix, join or fasten Detachable Multi-Functional Housing Compartment Insert Assembly while still inserted within its embodiment. Nor do they allow the Attachable Door Cover Insert Panel Accessories to be changed interchangeably for different activities or settings.

Neither do they have Housing Compartment Card Insert Accessories that can be used to change the features or background of the concealed compartment for different uses such as a doll house or play room with optional floors, greeting card, scrapbook or pictures, social skills therapy or therapeutic drawings or images, inspirational messages, religious or educational settings, arts and crafts, or games used as activity play or participation.

Furthermore, novelty toys, inflatables, mascot or costumes do not have a multi-functional universal Housing Compartment Card Insert Accessories that allows the mounting, housing, supporting, attaching, concealing, securing, storing or displaying of a variety of universal Attachable Floorboard Inlay Accessories within or outside of its opening for various sceneries or settings.

Neither do novelty toys, inflatables, mascot or costumes have a Universal Attachable Receptacle Stand that have features to allow it to be mounted, attached, affixed, fastened, connected or secured to any of the following such as the Housing Compartment Card Insert Accessories, Attachable Door Covet Insert Panel Accessories, or optionally stand along by itself if desire by the end user.

In addition, Neither do novelty toys, inflatables, mascot or costumes have an Universal Attachable Receptacle Stand which comprises an optionally Receptacle Stand Compartment Opening to receive, house, accept, or store a Receptacle Stand Compartment Drawer.

Furthermore, novelty toys, inflatables, mascot or costumes do not have Universal Receptacle Stand Inlay Panel Accessories to be independently or optionally mounted, attached, affixed, fastened, connected or secured to any of the following such as the Universal Attachable Receptacle Stand, Housing Compartment Card Insert Accessories, Attachable Door Cover Insert Panel Accessories or the Attachable Door Cover Inserts.

Neither do novelty toys, inflatables, mascot nor costumes have a DETACHABLE SHAPE TEMPLATE that can be interchangeably attached to the body cavity of the novelty toys, inflatables, mascot or costumes. The detachable shape template may be formed or fashioned in a variety of the following but not limited to; holiday, carnival, party, special or romantic shapes, alphabet, heart, numbers, phrases, photo, pictures, arts or crafts, sports icons or figures, entertainers or celebrities.

Thus, there is a need for a novelty toy, inflatable, mascot or costume that features a UNIVERSAL detachable multi-functional housing compartment insert assembly that comprises a plurality of Attachable Accessory Templates that are used to provide various activities in different settings involving such as but not limited to; Global Education Initiative, Creative Curriculum learning, Inquiry Based Learning, Connected Learning, Sand Play or Sand Tray Therapy, Early Child Development programs, Recreation Therapy, STEAM Education and Project-Based Learning, Expressive Arts Therapy, Game Based Learning with the use of (e.g., Tablets, Smartphones, Android, Mobile technology, Kindle Fire, Nook, iPad or Samsung devices), social skill activities, teddy bear play therapy, adult or children counseling sessions, learning activities or games, using transitional objects in a therapeutic setting, children or behavioral hospitals, day cares, private or public schools, just to name a few. Also with the option of flexibility for sporting games that features multiple activities in one setting such as but not limited to, carnival or toss games, arts and crafts, "bingo", "flash cards", "tic-tac-toe", "pin the tail on the donkey", football, baseball, basketball, cricket, golf, bowling, dartboard and/or soccer, or if desired one can house, store, secure, package, or conceal plants, terrariums, diorama, greenhouse or garden, sandbox or sand tray, urns, reptile habitat or insect lore, hermit crab or fish tank enclosures, boxed chocolates or candy, flowers, jewelry, picture frame, candles, travel sized items, garments or clothing items, electronic devices (e.g., Tablets, Smartphones, Android Devices, Mobile technology, Kindle Fire, Nook, iPad, Samsung, or Windows Phone), gift baskets, journals, baby accessories, doll houses, figurines, dolls or dollhouse accessories, display cases, bouquets, shadow boxes, cakes, just to name a few.

SUMMARY OF THE INVENTION

The present invention provides an improvement to a previous granted application Ser. No. 12/653,439, U.S. Pat. No. 8,152,587. The present invention provides a detachable multi-functional housing compartment insert assembly comprising a plurality of Attachable Accessory Templates having a door insert slot within its embodiment which allows attachable accessories to be coupled, fastened, affixed, embraced, secured, housed, concealed, stored, mounted, attached or interchangeably placed, separately in one of the following body cavities of a novelty toy, mascot, costume or inflatable's embodiment that can be used by licensed or certified professionals to help engage individuals in therapy. These professional individuals are such as, but not limited to the following, Developmental Psychologist, Mental Health Or Substance Abuse Social Workers, Child And Family Social Workers, School Social Worker Or Counselors, Licensed Therapist, Licensed Counselor, Licensed Clinical Social Worker, Licensed Social Worker, Licensed Professional Counselor, Medical Social Worker, Play Therapists, Expressive or Creative Arts Therapist, Sand Tray Therapist, Recreational Therapists, Sensory Integration Therapy—Pediatric Occupational Therapy just to name a few.

Furthermore, the present invention can be used to help engage individuals in Educational, Children's or Behavioral hospital settings through the use of Activities for Child Development which includes Teddy Bear Therapy, Inquiry Based Learning, Connected Learning, Art Therapy, Pretend Play Therapy, Expressive Arts Therapy, Art based Teaching, Educational Therapy, Recreation Therapy, Imaginative Play, Therapeutic Recreation and/or Project Based Learning (PBL) activities, just to name a few.

The present invention can also be used to engage individuals including those who are Developmentally Delayed or with special needs who need an Individualized Education Program (IEP) or Curriculum designed to meet their individual needs. These programs or schools are such as, but not limited to the following, Curriculum Based Programs, S.T.E.A.M. Program, Early Childhood Education, Head Start, Preschool Programs, Child Care Programs, After School Programs, Private or Public Schools, S.T.E.M. Program, Charter or Magnet Schools, Independent or Parochial Schools, Home Schools and Daycares to help improve one's hand-eye coordination, fine or gross motor skills, pattern recognition, shapes, spatial relationships, socialization, letters, numbers, reading or writing skills.

The present invention can also be used as a standalone gift or novelty source such as but not limited to; greeting cards, arts and crafts, games, toys, sandboxes or sand trays, doll houses, floral designs, figurines, dolls or dollhouse accessories, greenhouse or garden, plants, terrariums, diorama, bouquets, shadow boxes, bug or insect lore, fish, pet, reptile habitat, gifts or novelty items to be placed, attached, concealed, stored, housed, packaged, mounted or secured internally or externally of the housing compartment.

In another configuration, the present invention provides a novelty toy, mascot, costume or inflatable toy having a detachable multi-functional housing compartment insert assembly comprising a Door Insert Slot located inside of its compartment cavity. The Attachable Door Cover Insert that can be snugly, hinged, placed, housed, secured or stored and/or attached within Door Insert Slot's cavity. The Attachable Door Cover Insert comes in various shapes, forms or designs including the option to Contain an Attachable Screen Protector Door Cover Insert that is used to guard, cover, shield, or aid to protect the screen surface of Electronic Devices Such As, But Not Limited To, (e.g., Tablets, Smartphones, Android Devices, Mobile technology, Kindle Fire, Nook, iPad, Samsung, or Windows Phone), or the use of acrylic or Transparency film or sheet for printed or laser designs as will be further discussed later. The Attachable Door Cover Insert is use to optionally hold, fasten, contain, secure, mount, enclosed or affix a variety of Attachable Door Cover Insert Panels which are used to display such as but not limited to, greeting cards, arts, games, crafts, box or basket designs, chalk or dry erase board, photo or laser engravings designs or plant holders just to name a few to its outer or inner surface. The Attachable Door Cover Insert when in a closed state can optionally secure, house, support, protect, reveal or conceal the standalone gift or novelty source that are placed or mounted within the multi-functional housing compartment insert assembly.

Furthermore, the present invention also provides an Attachable Door Cover Insert Panels that can be optionally coupled, attached, placed, secured, housed, stored, supported, mounted, held, affixed, retained or fastened to the outer flat surface walls or perimeter of the Attachable Door Cover Insert Accessory. The Attachable Door Cover Insert Panels Accessories are designed, formed, shaped or fashioned in various ways for different uses, purposes, functions or activities that includes but not limited to; alphabet, number, square, circle, heart, clover, star, diamond, oval, octagon, trapezoid, pentagon, hexagon, triangle, parallelogram, or rhombus shape(s), a structure, personalized or customized face, animal, insect, holiday image, carnival character, party personality, special or romantic shapes, alphabet, heart, numbers, phrases, photo image, pictures, arts or crafts, sports icons or figures, entertainers or celebrities. The Attachable Door Cover Insert Panels Accessories can also be in the form or design of a headboard, a writing or drawing board, greeting cards, arts, games, crafts, box or basket designs, chalk or dry erase board, photo or laser engravings designs or plant holders just to name a few to its outer or inner surface. Some Attachable Door Cover Insert Panels are designed with support braces that are used to optionally hold, fasten, contain, support, secure, mount, join or affix to other Attachable Door Cover Insert Panels or Receptacle Stand Inlay Panel Accessories.

The present invention provides a novelty toy body, inflatable body, mascot or costume body comprising a detachable multi-functional housing compartment insert assembly that has a cavity opening used to house, secure, place, hold, store or conceal a Housing Compartment Card Insert Accessory which is used to change the features or background of the concealed compartment for different uses such as but not limited to arts and crafts, chalk or dry erase board, alphabet or numbering chart, coloring card, writing or drawings, scrapbook, greeting card scenery, doll house or play room backdrop, picture or paintings, family, inspiration, religious, educational or carnival games and can be used as an entertaining, activity play setting. The Housing Compartment Card Insert Accessory can also be transformed or configured to optionally receive, housed, support, mounted, secure, place, hold, store, retain or keep Attachable Floorboard Inlays in place or be attached, mounted, secure, place, affixed, fastened or joined to the Attachable Receptacle Stand.

Furthermore, the present invention also provides an Attachable Floorboard Inlay Accessories that can be optionally coupled, attached, placed, secured, housed, stored, supported, mounted, held, retained or kept within the walls of the Housing Compartment Card Insert Accessory. The multi-functional Attachable Floorboard Inlay Accessories are designed, formed, shaped or fashioned in various ways for different uses, purposes, functions or activities that include, but not limited to the use forming a mini-self, mini-bookstand, doll closet or armoire, plant holder, jewelry encasement, figurines, dolls or dollhouse accessories, greenhouse or garden, terrarium, diorama, floral stand holder, sandbox or sand tray, gift basket receptacle, reptile habitat or insect lore, hermit crab or fish tank enclosure support base.

The present invention also comprises a novelty toy body, inflatable body, mascot or costume body that have an Attachable Receptacle Stand accessory that can be interchangeably coupled, attached, fastened, clipped, adjoined, affixed, secured, to the body cavity of the novelty toy body, inflatable body, mascot or costume body by optionally coupling one of the several accessories which comprises but not limited to the Attachable Door Cover Insert, Attachable Door Cover Insert Panels, Housing Compartment Card Insert Accessory or Attachable Floorboard Inlay Accessory. The Attachable Receptacle Stand has a generally rectangular cavity opening that may be formed, shaped or fashioned in a variety of the following shapes or figures on its flat surface such as, but not limited to; alphabet, number, square, circle, heart, clover, star, diamond, oval, octagon, trapezoid, pentagon, hexagon, triangle, parallelogram, or rhombus shape(s), a structure, personalized or customized face, animal, insect, holiday image, carnival character, party personality, special or romantic shapes, alphabet, heart, numbers, phrases, photo image, pictures, arts or crafts, sports icons or figures, entertainers or celebrities. The Attachable Receptacle Stand can also be in the form of a bed with an attachable headboard or footboard, a writing, thawing, sketching or painting desktop surface stand within its body structure designed to optionally to receive, house, accept, or store a Receptacle Stand Compartment Drawer within its Receptacle Stand Compartment opening. The Attachable Receptacle Stand also comprises an optionally opening on its flat surface to allow some of the following, but not limited to containers, figurines, dolls or dollhouse accessories, greenhouse or garden, planters, vases or trays just to name a few. Furthermore, the Attachable Receptacle Stand also comprises on the flat surface around its cavity opening, separable fasteners which are used to fasten, secure, house, stored, mount or attached Receptacle Stand Inlay Panel Accessories which will be briefly summarized next.

In another configuration, the present invention provides an apparatus comprising a novelty toy body, inflatable body, mascot or costume body that have an Attachable Receptacle Stand Inlay Panel Accessory that can be interchangeably coupled, attached, mounted, supported, connected, fastened, clipped, adjoined, affixed, secured, to any of the following attachable accessories such as Attachable Door Cover Insert, Attachable Door Cover Insert Panels, Housing Compartment Card Insert Accessory, Attachable Floorboard Inlay Accessory and/or Attachable Receptacle Stand The Receptacle Stand Inlay Panel Accessory may be formed, shaped or fashioned in a variety of the following but not limited to; alphabet, number, square, circle, heart, clover, star, diamond, oval, octagon, trapezoid, pentagon, hexagon, triangle, parallelogram, or rhombus shape(s), a structure, personalized or customized face, animal, insect, holiday image, carnival character, party personality, special or romantic shapes, alphabet, heart, numbers, phrases, photo image, pictures, arts or crafts, sports icons or figures, entertainers or celebrities. The Receptacle Stand Inlay Panel Accessory can also be in the form of a bed mattress with an attachable headboard or footboard, chalk or dry erase board, a writing, drawing, or sketching or painting desktop surface. The Receptacle Stand Inlay Panel Accessory also features an optionally variety of openings on its flat surface to allow some of the following, comprising of but not limited to golf, hockey, soccer, football, baseball, basketball, carnival or toss games, and all activity games that may be applied, figurines, dolls or dollhouse accessories, containers, greenhouse or garden, planters, vases or trays just to name a few.

In another configuration, the present invention provides an apparatus comprising a novelty toy body, inflatable body, mascot or costume body that have an Attachable Shape Template Accessory that can be interchangeably attached, fastened, clipped, adjoined, affixed, secured, to the body cavity's surface section of the novelty toy body, inflatable body, mascot or costume body. The Attachable Shape Template Accessory may be formed or fashioned in a variety of the following but not limited to; a personalized or customized face, animal, insect, holiday image, carnival character, party personality, special or romantic shapes, alphabet, heart, numbers, phrases, photo image, pictures, arts or crafts, sports icons or figures, entertainers or celebrities. The Attachable Shape Template Accessory can also be in the form of a bed headboard or footboard with an opening on its flat surface to allow a detachable multi-functional housing compartment insert assembly with various attachable accessory templates to be coupled, fastened, secured, housed, concealed, stored or attached by concealed compartment separable fasteners.

Furthermore, the present invention provides a novelty toy body, inflatable body, mascot or costume body that has a detachable multi-functional housing compartment insert assembly within its embodiment that allows an Attachable Door Cover Insert to be coupled, snugly, hinged, placed, housed, secured or stored and/or attached within its Door Insert Slot's cavity. The Attachable Door Cover Insert comprises of assorted shapes, forms or designs including the option to include an Attachable Screen Protector Door Cover Insert, acrylic, transparency film or sheet for printed or laser designs as will be further discussed later. The Attachable Door Cover Insert is use to optionally couple, hold, connect, attach, join fasten, contain, secure, mount, enclosed or affix to a variety of Attachable Door Cover Insert Panels which are used to display such as but not limited to, greeting cards, arts, games, crafts, box or basket designs, chalk or dry erase board, photo or laser engravings designs or plant holders just to name a few to its outer or inner surface. The detachable multi-functional housing compartment insert assembly also comprises a Housing Compartment Card Insert Accessories that can be optionally placed, received, affixed, attached, housed, stored, secure within its embodiment that allows the backdrop or background features to be changed to such as, but not limited to a greeting card, art or drawing card just to name a few. The Housing Compartment Card Insert Accessories can also function as a standalone source or be joined, affixed, connected, attached, mounted, fastened to the Attachable Receptacle Stand. The Attachable Receptacle Stand accessory can be interchangeably attached, fastened, clipped, adjoined, affixed, secured, to the body cavity of the novelty toy body, inflatable body, mascot or costume body by optionally using one of the several accessories which comprises but not limited to the Attachable Door Cover Insert, Attachable Door Cover Insert Panels, Housing Compartment Card Insert Accessory or Attachable Floorboard Inlay Accessory. One of the functions of the Attachable Receptacle Stand is to allow the Receptacle Stand Inlay Panel Accessories to be interchangeably coupled, supported, secured, fastened, joined, affixed or mounted to its flat surface around its perimeter. The Receptacle Stand Inlay Panel Accessories can be interchangeably coupled, attached, mounted, supported, connect, fastened, clipped, adjoined, affixed, secured, to any of the following attachable accessories such as Attachable Door Cover Insert, Attachable Door Cover Insert Panels, Housing Compartment Card Insert Accessory, Attachable Floorboard Inlay Accessory and/or Attachable Receptacle Stand. In another configuration, the present invention provides an apparatus comprising a novelty toy body, inflatable body, mascot or costume body that have an Attachable Shape Template Accessory that can be interchangeably attached, fastened, clipped, adjoined, affixed, secured, to the body cavity's surface section of the novelty toy body, inflatable body, mascot or costume body.

In accordance with the present invention, there is provided a plush toy, mascot, costume or inflatable embodiment configured in the form of an animal-like, holiday symbol or icon, humanoid or other character. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views.

FIG. 2A is a front perspective view of the Attachable Door Cover Insert displaying a complete flat surface.

FIG. 2B is a front perspective view of the Attachable Door Cover Insert displaying a full flat surface with a circle opening cutout.

FIG. 2C is a front-side perspective view of the Attachable Door Cover Insert displaying a full flat surface with a half oval shape opening cutout towards the bottom and panel support brackets with separable fasteners on its surface.

FIG. 2D is a front-side perspective view of the Attachable Door Cover Insert displaying a partial flat surface with a full vertical rectangular shape opening cutout, with displaying the fasteners to support a variety or host of other attachments such as but not limited to, stands or accessories.

FIG. 2E is a rear view of the Attachable Door Cover Shelf Accessory displaying several circle opening cutouts on its flat surface with a plurality of support brackets with separable fasteners on its surface.

FIG. 4A is a front perspective view of Attachable Door Cover Insert Panel with Basketball design being attached to the Attachable Door Cover Insert and displaying separable fasteners.

FIG. 4B is a front perspective view of the Detachable Multi-Functional Housing Compartment receiving the Attachable Door Cover Insert's Pivot Arm and displaying the Attachable Door Cover Insert Panel with panel support brackets with separable fasteners on its surface.

FIG. 4C is a front perspective view of the Attachable Door Cover Insert and Attachable Door Cover Insert Panel with a flat surface displaying a Greeting Card sample.

FIG. 4D is a front perspective view of the Attachable Door Cover Insert and an Attachable Door Cover Insert Panel displaying a house with a mail box cutout opening design in front. Both are displaying separable fasteners.

FIG. 4E is a rear perspective view of the Attachable Door Cover Insert and Attachable Door Cover Insert Panel displaying the rectangular shape cut out openings with a mail box inserted inside. Both are displaying separable fasteners.

DETAILED DESCRIPTION OF THE INVENTION

Figure 1C:
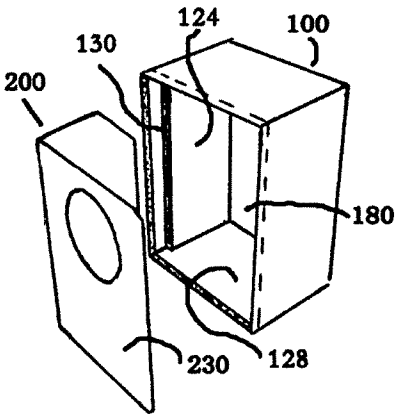
FIG. 1C is a perspective view of the detachable multi-functional housing compartment insert assembly displaying its opening, door insert slot and showing the Attachable Door Cover Insert.

Turning now descriptively to the drawings, in which similar reference characters denote similar elements throughout the several views, the attached figures illustrate a detachable multi-functional housing compartment insert assembly comprising attachable accessory templates to be coupled, fastened, secured, housed, concealed, stored or attached by concealed compartment fasteners to allow an interchangeably and/or separate placement in one of the following body cavities comprising of a novelty toy body, inflatable body, mascot or costume body's embodiment that allows the coupling of a plurality of Attachable accessory templates to be removable or interchangeably inserted and/or attached inside the detachable multi-functional housing compartment to couple, hold or affix a variety of arts, games, crafts, box or basket designs to its outer or inner surface. The novelty toy body, inflatable body, mascot or costume body comprising the detachable multi-functional housing compartment insert assembly comprising a plurality of Attachable Accessory Templates are also used to provide various activities in different settings involving such as but not limited to; Global Education Initiatives, Creative Curriculum learning, Inquiry Based Learning, Connected Learning, Sand Play or Sand Tray Therapy, Early Child Development programs, Recreation Therapy, STEAM Education and Project-Based Learning, Expressive Arts Therapy, assisting commonly approaches to learning in Educational Psychology including Behaviorism, Cognitivism, Social Cognitivism, and Constructivism, and/or Game Based Learning with the optional use of (e.g., Tablets, Smartphones, Android, Mobile technology, Kindle Fire, Nook, iPad or Samsung devices), social skill activities, teddy bear play therapy, adult or children counseling sessions, learning activities or games, using transitional objects in a therapeutic setting, children or behavioral hospitals, day cares, private or public schools, just to name a few. It can also be used by licensed or certified professionals for therapy or therapeutic settings, educational or learning development settings for adults, children or individuals with special needs. The novelty toy body, inflatable body, mascot or costume body comprising the detachable multi-functional housing compartment insert assembly comprising a plurality of Attachable Accessory Templates is also used to engage individuals including those who are Developmentally Delayed or with special needs who need an Individualized Education Program (IEP) or Curriculum designed to meet their individual needs. These programs or schools are such as, but not limited to the following, Curriculum Based Programs, S.T.E.A.M. Program, Early Childhood Education, Head Start, Preschool Programs, Child Care Programs, After School Programs, Private or Public Schools, S.T.E.M. Program, Charter or Magnet Schools, Independent or Parochial Schools, Home Schools and Daycares to help improve one's hand-eye coordination, fine or gross motor skills, pattern recognition, shapes, spatial relationships, socialization, letters, numbers, reading or writing skills. The Attachable Screen Protector Door Cover Insert is used to hold, secure, protect, conceal, cover an Electronic Device (e.g., Tablet, Smartphone, Android Device, Mobile Technology, Kindle Fire, Nook, iPad, Samsung, Or Windows Phone) while being coupled or attached to an Electronic Device Placeholder. It is also used to aid in protecting arts, graphics, games or paintings that are housed inside of the detachable multi-functional housing compartment insert assembly. The Attachable Door Cover Insert Panel couples or attaches to the Attachable Door Cover Insert, these panels are designed in a plurality or various shapes, patterns or sizes comprising in the forms of such as but not limited to, basketball panel, photo panel, greeting card, chalk or dry erase board panel, or doll house panel, just to name a few. The Housing Compartment Card Insert Accessory can be optionally housed, stored, secured, within the Detachable Multi-Functional Housing Cavity Compartment or used as a standalone accessory comprising such as but not limited to a greeting card, art painting or 3D photo. It also has a very broad range of usages comprising such as but not limited to changing the background features of the Detachable Multi-Functional Housing Cavity's Compartment. The Detachable Multi-Functional Housing Cavity's Compartment has optional separable fasteners on its surface that allows it to be interchangeably attached, mounted, supported, connected, fastened, clipped, adjoined, affixed, secured or coupled to any of the following attachable accessories such as the Attachable Door Cover Insert, Attachable Door Cover Insert Panels, Attachable Floorboard Inlay Accessory and/or Attachable Receptacle Stand. The Attachable Floorboard Inlay Accessories are housed, stored, secured, affixed, placed, supported, fastened or coupled to wall brackets located on the Housing Compartment Card Insert Accessory's surface, they are also used to interchangeably change the configuration, formation, structure, construction, assembly or arrangement for various settings once placed inside of the of the Housing Compartment Card Insert Accessory. The Attachable Floorboard Inlay Accessories are also used to interchangeably couple, brace, secure, support attach or hold items within the Housing Compartment Card Insert Accessory's wall structure, construction, assembly or arrangement. The Attachable Receptacle Stand, can be optionally coupled, attached, fastened, adjoined, housed, stored, or secured to the separable fasteners of the Housing Compartment Card Insert Accessory or used as a standalone accessory such as but not limited to a writing desktop surface, toss game, trace light desk surface, or used to support, secure, affix to, hold, attach, connect, fasten or coupled to a variety types of Attachable Receptacle Stand Inlay Panel Accessories. The Attachable Receptacle Stand Inlay Panel Accessory comprises separable fasteners underneath it surface that allows it to be interchangeably coupled, attached, mounted, supported, connected, fastened, clipped, adjoined, affixed, secured, to any of the following attachable accessories comprising such as the Attachable Door Cover Insert, Attachable Door Cover Insert Panels, Housing Compartment Card Insert Accessory, Attachable Floorboard Inlay Accessory and/or Attachable Receptacle Stand. The detachable multi-functional housing compartment insert assembly also allows a detachable shape template accessory to be interchangeably coupled, attached, secured, affixed, or fastened to the novelty toy body, inflatable body, mascot or costume's body by the use of detachable shape template separable fasteners.

Referring now to the drawings, and specifically to FIGS. 1A-11F. The novelty toy body is generally denoted by the reference numeral 1100, the inflatable body by reference 900, and the mascot or costume body by reference 950. The novelty toy body 1100, inflatable body 900, mascot or costume body 950 comprising a body cavity 1200, a top surface, a bottom surface, a back or rear surface, internal body fasteners 160 as seen in FIG. 1B, and a pair of opposite ends configured to receive, house or store a detachable multi-functional housing compartment insert assembly 100 within its cavity. The novelty toy body 1100, inflatable body 900, mascot or costume body 950 also comprises an outer covering 1250 which is made from safe material suitable for the usage by children. The material may also comprise such as without limitation, vinyl, faux fur, fabric shell with filling, foamed rubber, polyurethane, plastic or other fitting material generally used in the manufacturing of stuffed or plush toys, inflatables, mascots or costumes or cushioned toy products. The novelty toy body 1100, inflatable body 900, mascot or costume body 950 outer covering 1250 is contoured to form any attractable animal-like, symbol or icon, mascot, bird, fish, two or four legged animal, reptile-like holiday symbol, icon, humanoid or other characters recognizable or known to children or adults, the characters may comprise such as without limitation Fair or Carnival Characters, Entertainers, Sport Figures/Icons, Mascots, Holiday Figures/Icons, Mickey Mouse, Winnie the Pooh, Bugs Bunny, Big Bird, Barney, SpongeBob SquarePants, or any other characters created by Walt Disney, Inc., Warner Brothers, Public Broadcasting Service (PBS), or Nickelodeon just to name a few.

Figure 1E:
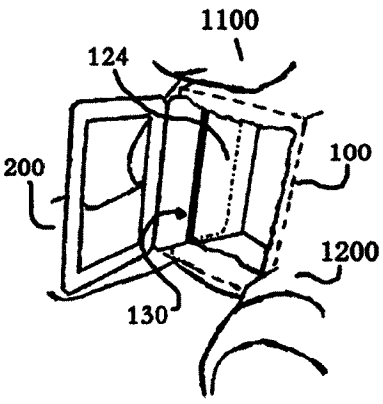
FIG. 1E is a front partial perspective view of the novelty toy displaying the detachable multi-functional housing compartment insert assembly holding the Attachable Door Cover Insert within its Door Insert Slot.
Figure 1B:
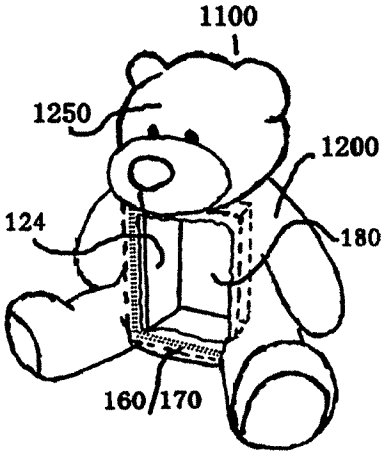
FIG. 1B is a front perspective view of the novelty toy body displaying the detachable multi-functional housing compartment insert assembly within its embodiment.
Figure 1A:
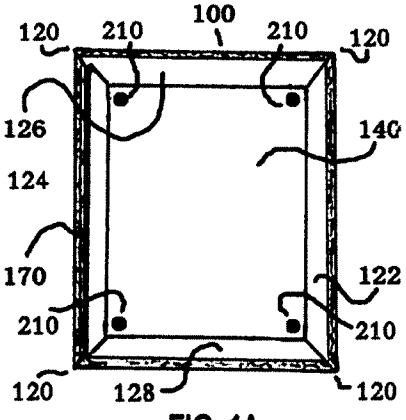
FIG. 1A is an exploded front view of the detachable multi-functional housing compartment insert assembly displaying its opening, door insert slot cavity and showing the internal separable fasteners.
Figure 1D:
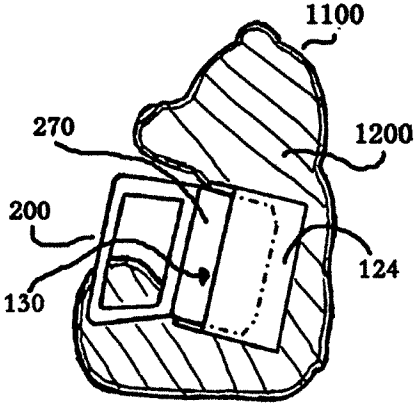
FIG. 1D is a cross-sectional view along the plane of FIG. 1B displaying the Attachable Door Cover Insert being housed inside of the detachable multi-functional housing compartment insert assembly that is the novelty toy's embodiment
Figure 9B:
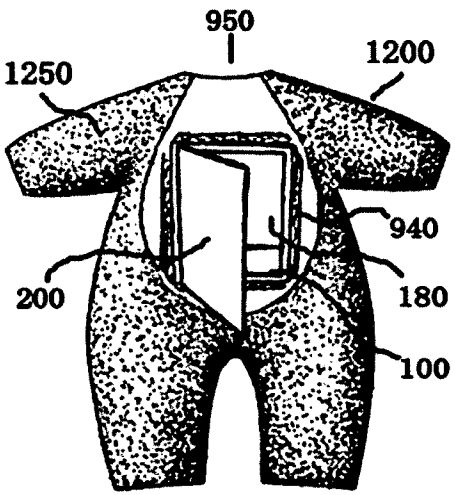
FIG. 9B is a front view of the mascot or costume body displaying the changeable shape template body fasteners with the detachable multi-functional housing compartment insert assembly and the Attachable Door Cover Insert housed, stored, secured, placed or inserted within its body cavity.
Figure 9C:
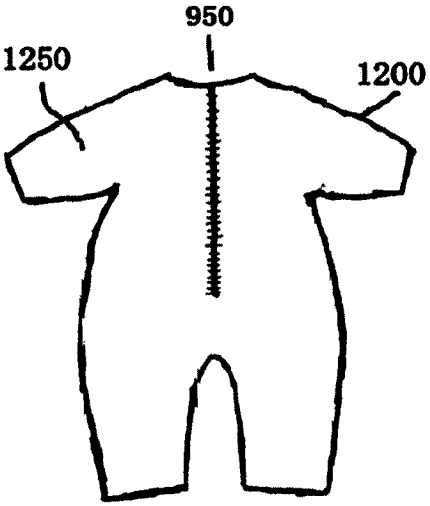
FIG. 9C is a rear view of the mascot or costume body displaying the body fasteners.
Figure 9A:
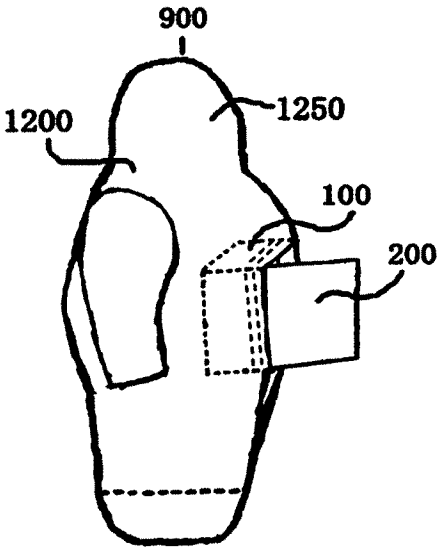
FIG. 9A is a perspective side view of the novelty inflatable toy body displaying the detachable multi-functional housing compartment within the body cavity of the novelty inflatable toy body.

As specifically shown in FIGS. 1A-1E and 9A-9B. The detachable multi-functional housing compartment insert assembly is generally denoted by the reference numeral 100. The detachable multi-functional housing compartment insert assembly 100 can be optionally interchangeably nested inside the body cavity 1200 of a traditional or conventional novelty toy body 1100 as seen in FIGS. 1B, 1D-1E, inflatable toy body 900 as seen in FIG. 9A, and/or mascot or costume body 950 as seen in FIG. 9B. The detachable multi-functional housing compartment insert assembly 100 can be optionally permanently nested, embedded, housed, secured, stored, concealed or placed within the novelty toy body 1100, inflatable body 900, mascot or costume body's 950 cavity 1200 as best seen in FIGS. 1B, 1D-1E, FIG. 9A and FIG. 9B.

Figure 11A:
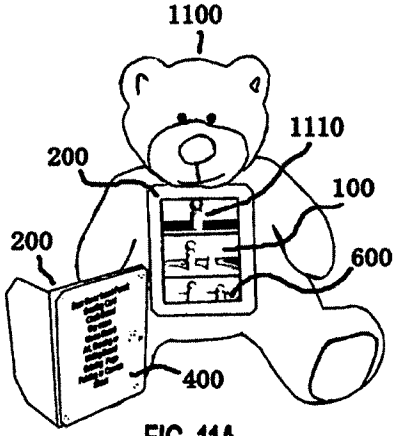
FIG. 11A is a front perspective view of the novelty toy body displaying a sample Doll House being housed, placed, stored or secured inside the detachable multi-functional housing compartment insert assembly, with an unattached Door Cover Insert and Panel Accessory on display.
Figure 11B:
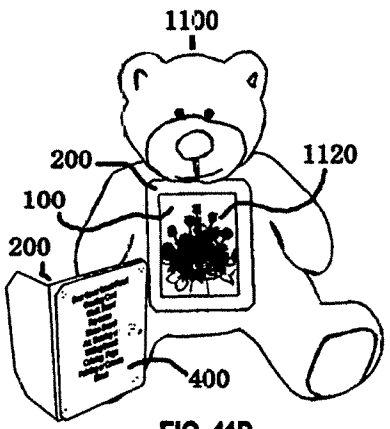
FIG. 11B is a front perspective view of the novelty toy body displaying a sample Rose Floral Arrangement being housed, placed, stored or secured inside the detachable multi-functional housing compartment insert assembly, with an unattached Door Cover Insert and Panel Accessory on display.
Figure 11C:
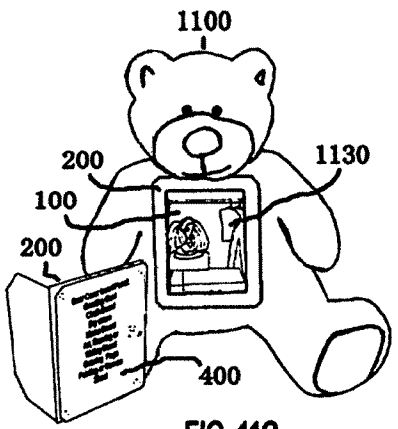
FIG. 11C is a front perspective view of the novelty toy body displaying a sample Doll Armoire being housed, placed, stored or secured inside the detachable multi-functional housing compartment insert assembly, with an unattached Door Cover Insert and Panel Accessory on display.
Figure 11D:
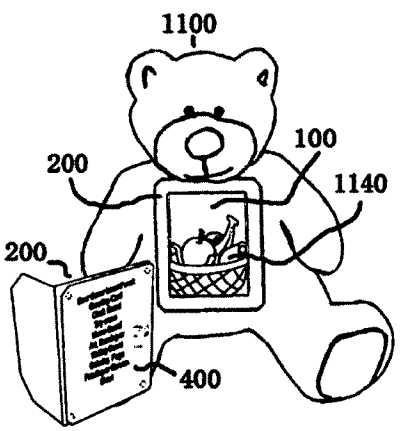
FIG. 11D is a front perspective view of the novelty toy body displaying a sample Gift Basket being housed, placed, stored or secured inside the detachable multi-functional housing compartment insert assembly, with an unattached Door Cover Insert and Panel Accessory on display.
Figure 11E:
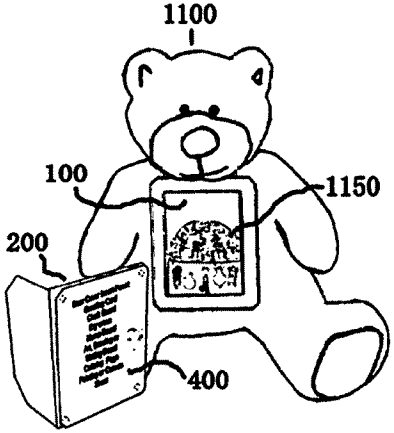
FIG. 11E is a front perspective view of the novelty toy body displaying a sample Terrarium being housed, placed, stored or secured inside the detachable multi-functional housing compartment insert assembly, with an unattached Door Cover Insert and Panel Accessory on display.
Figure 11F:
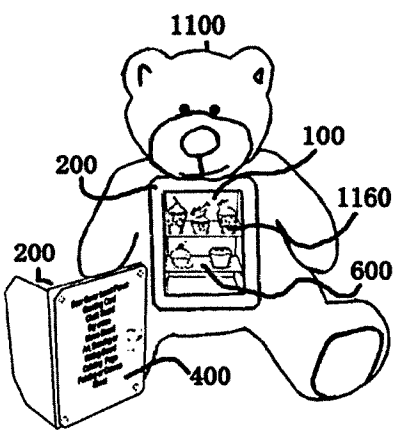
FIG. 11F is a front perspective view of the novelty toy body displaying a sample cupcake holder housed, placed, stored or secured inside the detachable multi-functional housing compartment insert assembly, with an unattached Door Cover Insert and Panel Accessory on display.
Figure 12:
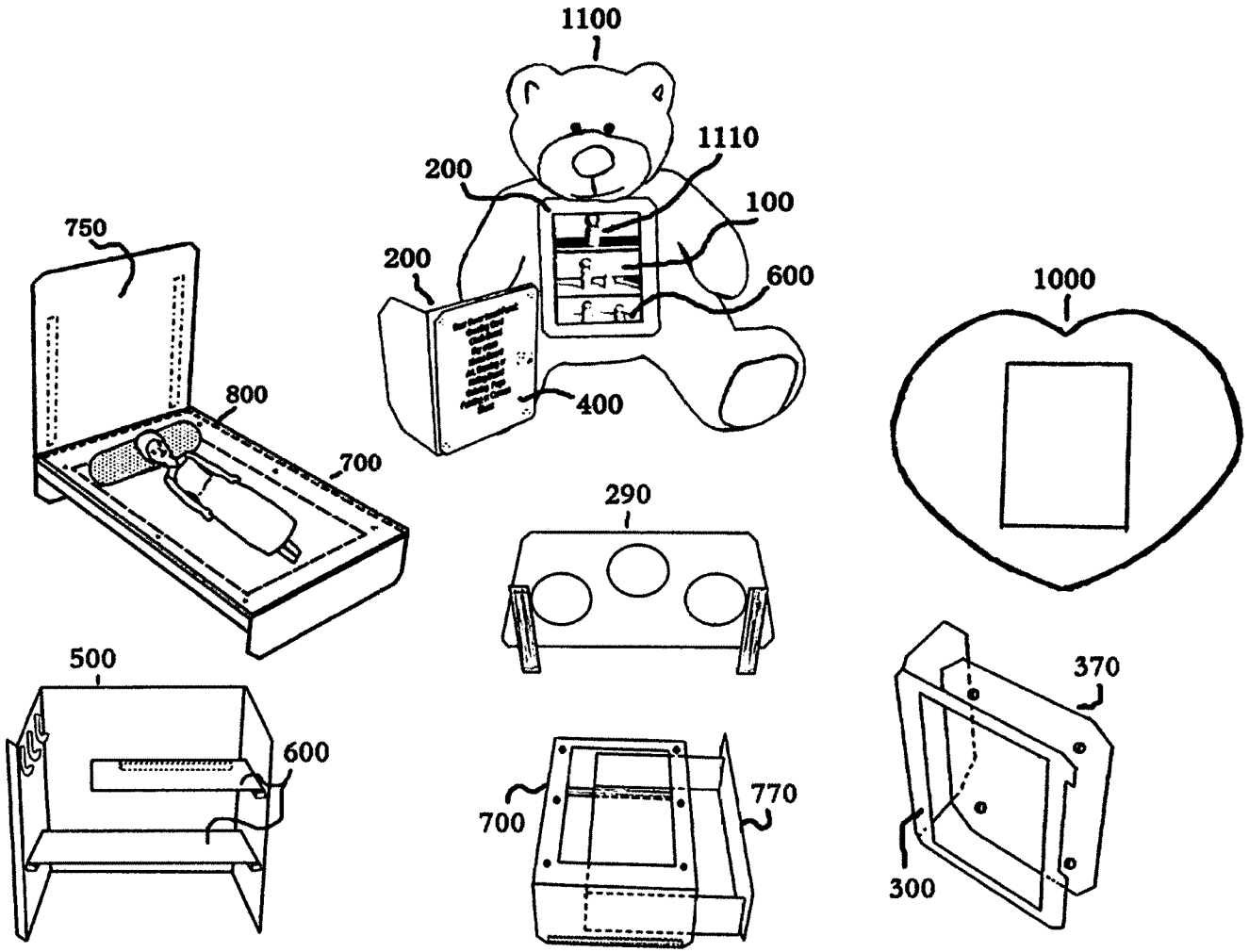
FIG. 12 is a front and perspective views of the novelty toy body displaying a detachable multi-functional housing compartment insert assembly comprising a variety of attachable accessory templates.

As best seen in FIGS. 1A, 1C, 3C-3D, 4B, 5A, 7C, 7E, 8C, 8E, 9A-B, 10D, and 11A-11F, the detachable multi-functional housing compartment insert assembly 100 having a top surface 126, a bottom surface 128, an opposite end flat surface 122 with one end having an inner wall 124 forming a Pivot Arm cavity slot 130 used to interchangeably couple, receive, house, adjoin, attach, connect, hold, support and secure the Attachable Door Cover Insert's Pivot Arm 270 as best seen in FIGS. 1A-1E. The Pivot Arm cavity slot 130 also prevents the Attachable Door Cover Insert's Pivot Arm 270 from moving side to side by securing the Pivot Arm 270 in a firm but snuggly position. Also seen in FIG. 1D, is a cross-sectional view along the plane of FIG. 1B displaying the multi-functional housing compartment insert assembly 100 which is stored, housed, secured or concealed within the novelty toy's body 1100 embodiment, thus revealing the Attachable Door Cover Insert's Pivot Arm 270 being coupled or housed inside of the Pivot Arm cavity slot 130. Best seen in FIG. 1A, the detachable multi-functional housing compartment insert assembly 100 also comprises a general compartment cavity 180, having several corners 120 forming the general compartment cavity 180, a plurality optional of separable fasteners 210 on a back or rear surface 140 to complete a generally general compartment cavity 180 for receiving a plurality of Attachable Accessory templates as seen in FIG. 12, comprising an Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770 Receptacle Stand Inlay Panel Accessory 800, and Attachable Shape Template Accessory 1000, as seen in FIGS. 1A, 1C, 3C-3D, 4B, 5A, 7C, 7E, 8C, 8E, 9A-B, 10D, and 11A-11F. The general compartment cavity 180 shape is arranged such that it tracks the shape of the novelty toy body 1100, inflatable body 900, mascot or costume body's 950 cavity 1200, as seen in FIGS. 1B, 1D and 1E.

As seen in FIGS. 1A-1C, the detachable multi-functional housing compartment insert assembly 100 has several concealed compartment internal fasteners 170 seen in FIG. 1A, located on its inner rim, edge, border, brim, brink or flange, best in FIG. 1A which are used to be received, attached, closed, fastened, clamped, secured or housed within the novelty toy body 1100, inflatable body 900, mascot or costume body 950 cavity's 1200 internal body fasteners 160 as seen in FIG. 1B. The concealed compartment internal fasteners 170 and internal body fasteners 160 may be separable fasteners, magnets or optionally permanently bonded together as seen in FIG. 1B.

The novelty toy body 1100, inflatable body 900, mascot or costume body 950 may also be constructed into other various shape or forms, apart from a sitting structure as seen in FIG. 1B, comprising such as without limitation a standing, prone, kneeling, horizontal or slanted position or posture. A center of gravity is the preferred posture provided for the novelty toy body 1100 or inflatable toy body 900 that allows them to be positioned in an upright position on a horizontal surface.

As best seen in FIGS. 1D, 3A-3D, 5A-5E, 6A-6E, and 11A-11F the detachable multi-functional housing compartment insert assembly 100 is designed to couple, hold, fasten, secure, house, conceal, attach, adjoin, or place a variety of interchangeable attachable accessory template inserts within its general compartment cavity 180 which comprises, but not limited to an Attachable Door Cover Insert 200, Attachable Screen Protector Door Cover Insert 300, Housing Compartment Card Insert Accessory 500, and/or Attachable Floorboard Inlay Accessory 600. Other traditional and conventional novelty items include but not limited to trinkets, terrariums, diorama, plants, sandbox or sand tray, figurines, dolls or dollhouse accessories, greenhouse or garden, bug or insect lore, pet, fish, reptile habitat or aquarium, cupcakes, games, school supplies, arts and crafts, jewelry, clothing, toys, edible foods for humans or pets, photo album, digital camera, a jewelry box and/or a box of chocolates. To show each novelty item is prohibitive, however as seen in FIGS. 11A-9F, are samples being displayed inside of the detachable multi-functional housing compartment insert assembly 100, comprising such as but not limited to a Doll House Setting 1110 in FIG. 11A, Rose Floral Arrangement 1120 in FIG. 11B, Doll Armoire Display 1130 in FIG. 11C, Gift Basket Presentation 1140 in FIG. 11D, Terrarium 1150 in FIG. 11E, and Cupcake Holder 1160 in F.

The detachable multi-functional housing compartment insert assembly 100 can be made of any resilient safe material suitable for the usage by children, comprising such as without limitation, wood, chipboard, cardboard, plastic, acrylic, fabric, rubber, and weave or wicker material. The detachable multi-functional housing compartment insert assembly 100 may also be constructed into other various shapes or forms, apart from a rectangular shape, comprising such as without limitation, an alphabet, number, alphabet, number, square, circle, heart, clover, star, diamond, oval, octagon, trapezoid, pentagon, hexagon, triangle, parallelogram, or rhombus shape(s), humanoid, celebrity, sport figure or animal shape. It can be made of chipboard, cardboard box or corrugated pads, Styrofoam, rubber, fabric, foam, weave, wicker or metal material. The detachable multi-functional housing compartment insert assembly 100 may also be place in a different area or section of the novelty toy body 1100, inflatable body 900, mascot or costume body's 950 cavity 1200. The detachable multi-functional housing compartment insert assembly 100 can also feature a permanent or fixed Attachable Door Cover Insert 200 that also allows, permits, supports, enables, or grants access to the detachable multi-functional housing compartment insert assembly 100.

Figure 10D:
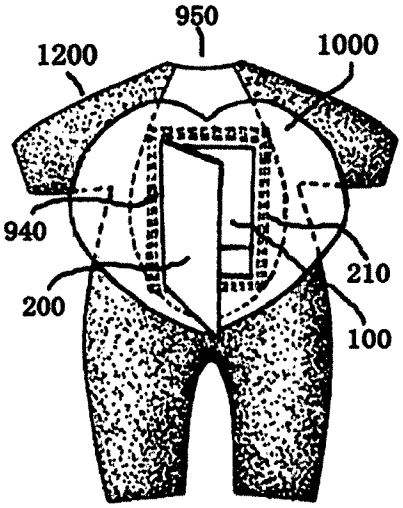
FIG. 10D is a front view of the novelty mascot or costume body displaying the detachable shape template accessory being secured, affixed, attached or fastened to the detachable shape template body fasteners while joined or connected to the detachable shape template fasteners located on the detachable shape template's rear side.

As shown in FIGS. 1C-1E, 2A-2E, 3A-3B, 4A-F, 5D-5E, 9A-9B, and 10D. The detachable multi-functional housing compartment insert assembly 100 has a Pivot Arm cavity slot 130, located within its housing compartment 100 that is designed to receive or store an Attachable Door Cover Insert's 200 Pivot Arm 270, as seen in FIGS. 1C-1E. The Attachable Door Cover Insert 200 accessory as seen in FIGS. 2B-2D is generally shaped in an elongated octagon form, but is also designed, arranged, or fashioned in a variety, diversity, assortment, array, or plurality of contour shaped doors that has several features and functions that optionally includes such as, but not limited to the following, a plurality of panel support brackets 260 with separable fasteners 210 on its surface. As seen in FIG. 2D, the Attachable Door Cover Insert 200 accessory has located on its front surface 230, a plurality of door cover attachment separable fasteners 210 which are used to interchangeably hold, secure, attach, affix, adjoin or fasten a plurality of accessory templates such as but not limited to the following, an Attachable Door Cover Shelf Accessory 290 seen in FIG. 2E, Attachable Screen Protector Door Cover Insert 300 seen in FIG. 3A-3B, Attachable Door Cover Insert Panels 400 seen in FIGS. 4A-4E, Housing Compartment Card Insert Accessory 500 seen in FIGS. 5D-5E, and/or Attachable Receptacle Stand 700 seen in FIG. 7C. In FIGS. 9A-9B, the Attachable Door Cover Insert 200 is shown attached, fastened, housed, secured, inserted or affixed within the multi-functional housing compartment's insert 100 while located in the embodiment of an inflatable 900 FIG. 9A, mascot or costume's 950 FIG. 9B body cavity 1200. In FIG. 10D, Attachable Door Cover Insert 200 is shown in an open state while securely placed inside of a detachable multi-functional housing compartment insert assembly's 100 general compartment cavity 180. The Attachable Shape Template Accessory 1000 being in the form of a heart is fastened, connected, attached to a mascot or costume's 950 body cavity 1200.

Figure 3B:
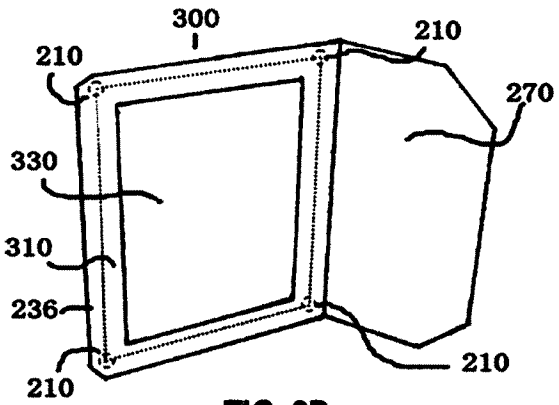
FIG. 3B is a back perspective view of the Attachable Screen Protector Door Cover Insert displaying Attachable Screen Protector Door Cover Insert outline and separable fasteners.

As seen in FIGS. 1C-1E, The Attachable Door Cover Insert 200 accessory can be optionally arranged, set, fixed or placed in such that it tracks the shape of the detachable multi-functional housing compartment insert assembly 100. The Attachable Door Cover Insert accessory 200 can be optionally secured, held, snuggly fitted, placed, housed, firmly closed within the opening of the general compartment cavity 180 located in the detachable multi-functional housing compartment insert assembly 100. As seen in FIGS. 2A, and 3A-B, the Attachable Door Cover Insert 200 accessory has several corners 220 with a front surface 230 and a back surface 236, it also comprises an Attachable Door Cover Insert's Pivot Arm 270 that hinges, swivels, axes, pivots, revolves, or swings to form a generally L-shaped formation when in a closed state over the detachable multi-functional housing compartment insert assembly's 100 general compartment cavity 180. The Attachable Door Cover Insert 200 has an optionally flat surface 230 on its door which can be constructed or configured to such as, but not limited to the following, a doll's headboard, toss game board, dart board, game board, dry erase or chalk board, art canvas board, paintings, drawings, graphics, pictures, notes and/or to attach, secure, mount, fasten, hold or clamp to games, educational or learning items as seen FIG. 2A.

As seen in FIG. 2B, the Attachable Door Cover Insert 200 has an optionally CIRCLE OPENING 240 through its door cover insert 200. The CIRCLE OPENING 240 allows fitting items such as balls or bean bags to enter into the detachable multi-functional housing compartment insert assembly's 100 general compartment cavity 180.

Figures 8A, 8B, 8C, 8D, 8E:
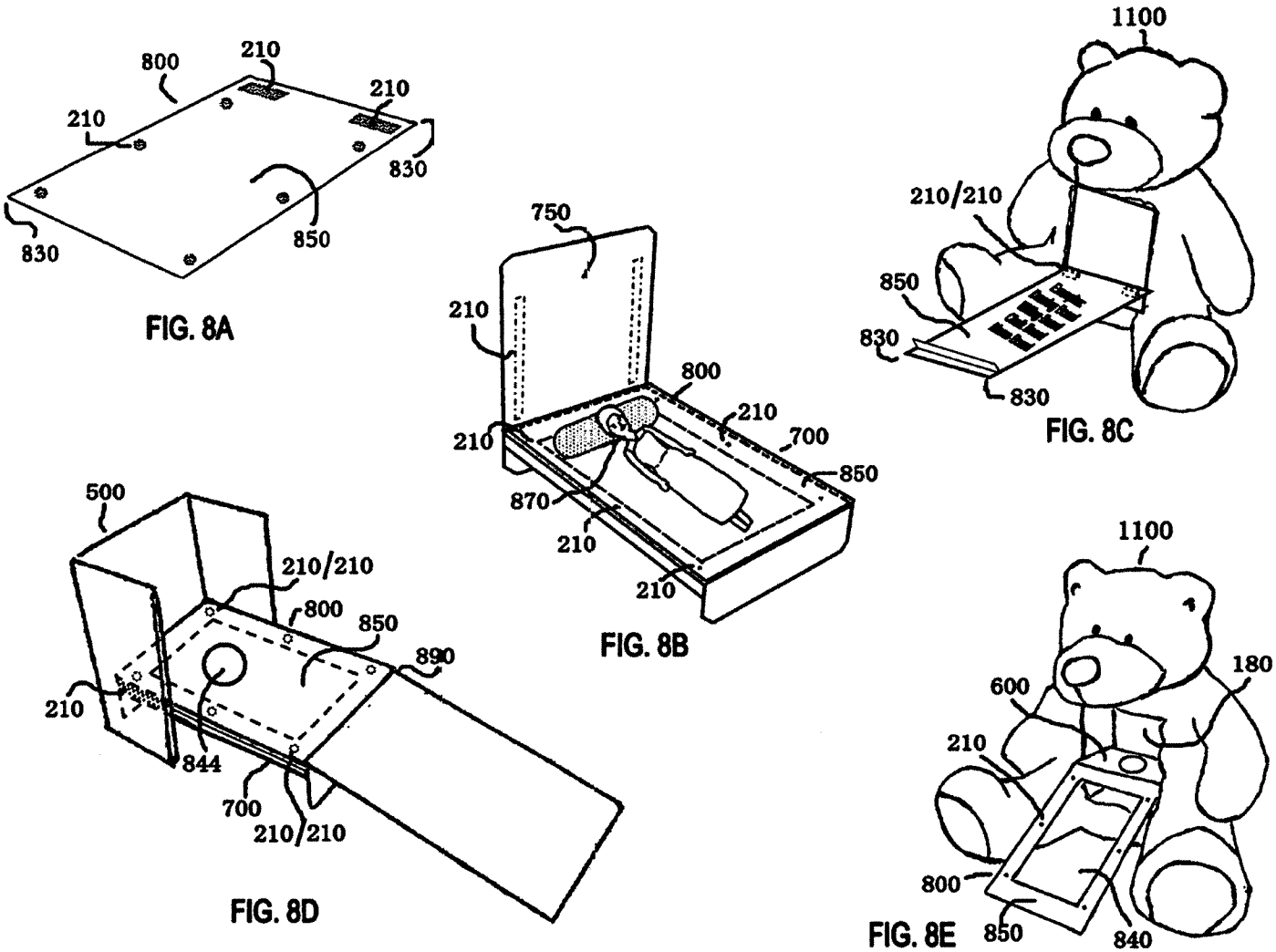
FIG. 8A is a top perspective view of the Receptacle Stand Inlay Panel Accessory that has been turned over to revealed its separable fasteners the bottom side of its horizontal flat surface.
FIG. 8B is a perspective view displaying a doll laying down on the horizontal flat surface of the Receptacle Stand Inlay Panel Accessory being coupled, attached or joined to the outlined Attachable Receptacle Stand with its optional vertical panel, revealing two outlined separable fasteners on its rear flat surface.
FIG. 8C is a front perspective view of the novelty toy and a Receptacle Stand Inlay Panel Accessory coupled or joined together by separable fasteners located on its reverse side to support brackets with separable fasteners which are attached to the outlined Door Cover Insert panel while displaying a sample writing surface.
FIG. 8D is a side perspective view of an attachment assembly comprising of several accessories, a Dual or Double Receptacle Stand Inlay Panel Accessory coupled or joined to an Attachable Receptacle Stand which is affixed or coupled to a Housing Compartment Card Insert Accessory all being joined by separable fasteners.
FIG. 8E is a front perspective view of the novelty toy and a Receptacle Stand Inlay Panel Accessory with a rectangular cutout opening and separable fasteners on its top flat surface, coupled or joined together with a Attachable Floorboard Inlay Accessory forming a ramp being attached to support brackets with separable fasteners on the side walls of a Housing Compartment Card Insert which is housed within the Detachable Multi-Functional Housing Compartment's cavity.

As Seen in FIG. 2C, the Attachable Door Cover Insert 200 has an optionally Delay Shape OPENING 250 through its door cover insert 200. Below the opening of the Delay Shape OPENING 250, are a plurality of panel support brackets 260 with separable fasteners 210 on its surface. The panel support brackets 260 with separable fasteners 210 are used to couple, support, hold, fasten, affixed, embraced, secured, mounted, attached to the Receptacle Stand Inlay Panel Accessories 800 as seen in FIGS. 8A and 8C. Whereas, in FIG. 8C, the plurality of panel support brackets 260 with separable fasteners 210 and the Receptacle Stand Inlay Panel Accessory 800 are coupled, joined, affixed, attached, fastened, secured, or clasped together to form a writing desk, sketch or drawing surface. The Delay Shape OPENING 250 in conjunction or unification with the Receptacle Stand Inlay Panel Accessories 800 allows appropriate, suitable and fitting items such as golf balls, bean bags or any other rolling object or ball to enter into the detachable multi-functional housing compartment insert assembly's 100 general compartment cavity 180.

As Seen in FIG. 2D, the Attachable Door Cover Insert 200 has an optionally Rectangular Shape OPENING 280 through its door cover insert 200. Also seen in FIG. 2D, the Attachable Door Cover Insert 200 has on its door surface, a plurality of optionally separable FASTENERS 210 which can also be coupled, fastened, affixed, joined, connected, embrace, secured, or attached to a plurality of support brackets 296 with separable fasteners 210 which are located on the Attachable Door Cover Shelf Accessory 290 as seen in FIG. 2E. The Attachable Door Cover Shelf Accessory 290 as seen in FIG. 2E, has several corners 292 to form a generally elongated octagon shape surface with an optionally openings 294 on its horizontal flat surfaces 298, and a plurality of support brackets 296 with separable fasteners 210 on its rear end. The Attachable Door Cover Shelf Accessory 290 is arranged to optionally support, hold or secure items such as but not limited to plants, toy, floral arrangement, or miniature novelty items on or within its optionally openings 294 as seen in FIG. 2E.

The Attachable Door Cover Insert accessory 200 can also be made of any resilient materials comprising such as without limitation, wood, cardstock, chipboard, cardboard, plastic, vinyl sheets, acrylic, foam, Styrofoam, fabric, rubber, and weave or wicker material. The Attachable Door Cover Insert accessory 200 may also be constructed into other various shapes or forms, apart from a rectangular shape, comprising such as without limitation, a float, carriage, vehicle, stage, aquarium, headboard, human or humanoid like figure, alphabet, number, square, circle, heart, clover, star, diamond, oval, octagon, trapezoid, pentagon, hexagon, triangle, parallelogram, or rhombus shape(s), or animal shape or mascot that are recognizable to children and/or adults. The Attachable Door Cover Insert 200 may optionally comprise different opening shapes through the front surface 230, these shape openings comprise of but not limited to an alphabet, number, square, rectangle circle, heart, clover, star, diamond, oval, octagon, trapezoid, pentagon, hexagon, triangle, parallelogram, or rhombus shape openings. As best seen in FIGS. 2B-2E and 8A, the Attachable Door Cover Insert 200 can also be formed, molded, fashioned, designed, shaped, outlined, made or contoured in various styles. Pending on its usage for licensed or certified professional therapy or therapeutic settings, Inquiry Based Learning, Connected Learning, educational or learning development settings for adults, children or individuals with special needs, the Attachable Door Cover Insert 200 can be used for games or learning activities that involves such as, but not limited to the following hand-eye coordination, fine or gross motor skills, pattern recognition, shapes, spatial relationships, socialization, letters, numbers, reading or writing skills. The Attachable Door Cover Insert accessory 200 may also be place in a different place or section of the novelty toy body 1100, inflatable body 900, mascot or costume body 950 cavity 1200.

Referring to FIGS. 3A-3D, 4B and 4E, the Attachable Door Cover Insert 200 accessory is also optionally constructed, formed or designed as an Attachable Screen Protector Door Cover Insert 300 seen in FIGS. 3A-3D. The Attachable Screen Protector Door Cover Insert 300 has a Transparency Screen Protector Film 330 attached, bonded, secured, joined or placed within its rectangular shape opening 310, seen in FIGS. 3A-3B. Also seen in FIGS. 1D-1E, 3A-B, the Attachable Screen Protector Door Cover Insert 300 has several corners 220 with a front surface 230 and a back surface 236, it also comprises an Attachable Door Cover Insert's Pivot Arm 270 that hinges, swivels, axes, pivots, revolves, or swings to form a generally L-shaped formation when in a closed state over the detachable multi-functional housing compartment insert assembly's 100 general compartment cavity 180. The Attachable Screen Protector Door Cover Insert 300 has a plurality of separable fasteners 210 on its front surface 230 that me used to mate, secure, affix, attach, connect or join to a plurality of separable fasteners 210 located on its back surface 460 of the Attachable Door Cover Insert Panels 400 as seen in FIG. 4E. As seen in FIG. 3A, the Attachable Screen Protector Door Cover Insert 300 also comprises contoured, outlined, formed or shaped corners 224 to allow or permit ease of access to the various Electronic Devices 398 operational control or panel switches such as the turn on, the off, or the volume control switches, these include but not limited to, a Tablet, Smartphone, Android Device, Mobile Technology, Kindle Fire, Nook, iPad, Samsung, or Windows Phone's operational keys, functions, buttons, controls or panel switches.

Figure 3D:
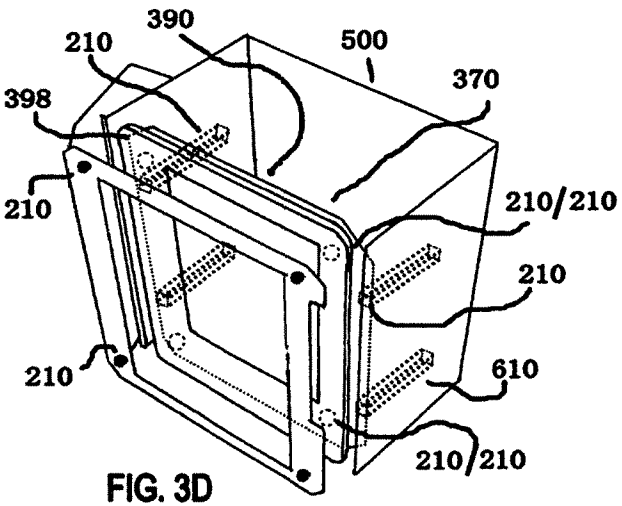
FIG. 3D is a front-side perspective view of the Attachable Screen Protector Door Cover Insert and Electronic Device (e.g., Tablet, Smartphone, Android Device, Mobile Technology, Kindle Fire, Nook, iPad, Samsung, Or Windows Phone) attached to the Electronic Device Placeholder being inside of a Compartment Card Insert.
Figure 3A:
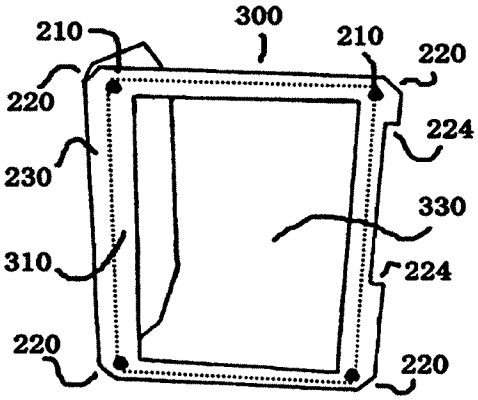
FIG. 3A is a front view of the Attachable Screen Protector Door Cover Insert displaying Attachable Screen Protector Door Cover Insert outline and separable fasteners.
Figure 3C:
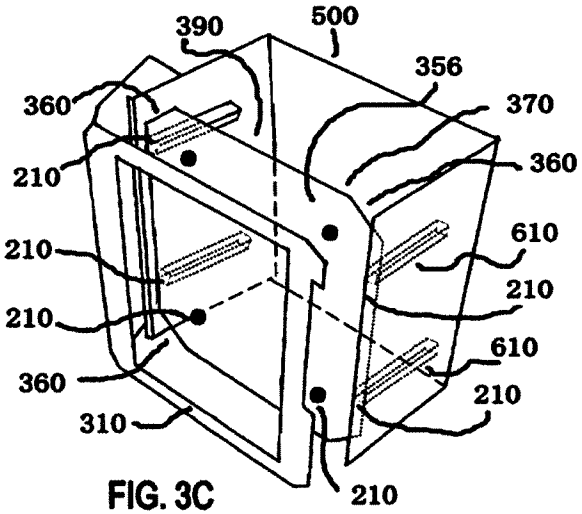
FIG. 3C is a front-side perspective view of the Attachable Screen Protector Door Cover Insert and Electronic Device Placeholder comprising wall brackets with separable fasteners attached inside of a Compartment Card Insert.

The Transparency Screen Protector Film 330 located within the rectangular shape opening 310, as seen in FIG. 3D, the Attachable Screen Protector Door Cover Insert 300 is used to optionally guard, cover, shield, or aid to protect the screen surface of Electronic Devices 398 such as, but not limited to a, Tablet, Smartphone, Android Device, Mobile Technology, Kindle Fire, Nook, iPad, Samsung, Or Windows Phone. The Electronic Device 398 is interchangeably securely attached, mounted, fastened, affixed or joined to an Electronic Device Placeholder 370 through the use of a plurality of separable fasteners 210, as seen in FIGS. 3C and 3D. The Transparency Screen Protector Film 330 can also be used to print arts, graphics, games, paintings or designs on the Transparency Screen Protector Film's 330 surface. The Attachable Screen Protector Door Cover Insert 300 is also used to optionally guard, cover, shield, or aid to protect arts, graphics, games or paintings that are housed or stored inside of the detachable multi-functional housing compartment insert assembly's 100, general compartment cavity 180.

The Attachable Screen Protector Door Cover Insert 300 is made of transparent film or clear material that allows the visualization, picturing or conception of the items placed within the detachable multi-functional housing compartment insert assembly's 100, general compartment cavity 180. The Attachable Screen Protector Door Cover Insert 300 can also be made of any resilient materials, comprising such as without limitation, clear plastic, acrylic, vinyl or transparency film or sheets material. The Attachable Screen Protector Door Cover Insert 300 is form, outline, or contoured shaped to allow or permit ease of access to the various Electronic Devices 398 such As, But Not Limited To, Tablet, Smartphone, Android Device, Mobile Technology, Kindle Fire, Nook, iPad, Samsung, Or Windows Phone's operational functions, buttons, switches, controls or panels.

As seen in FIGS. 3C and 3D, the Electronic Device Placeholder 370, has a plurality of CORNERS 360 that forms an elongated octagon shape, as seen in FIG. 3C. The Electronic Device Placeholder 370 comprises a plurality of separable fasteners 210 located on its front surface 356 which are used to interchangeably secure, hold, maintain, affix or attach to separable fasteners 210 on the back side to a variety of Electronic Devices 398 such as, but not limited to a Tablet, Smartphone, Android Device, Mobile Technology, Kindle Fire, Nook, IPad, Samsung, Or Windows Phone as seen in FIG. 3D.

Also as seen in FIG. 3C, the Electronic Device Placeholder 370, also having a plurality of separable fasteners 210 on its back surface 390 that are used to couple attach, connect, adjoin, affix, fasten, or secure to the front of a plurality of wall brackets 610 with separable fasteners 210. The wall brackets 610 with separable fasteners 210 are optionally secured, affixed or attached to the wall of the Housing Compartment Card Insert Accessory 500. Thus holding and securing the Electronic Device Placeholder 370 in a firm and stable position.

The Electronic Device Placeholder 370 can be made of any resilient materials comprising such as without limitation, wood, cardstock, chipboard, cardboard, acrylic, plastic, vinyl sheets, foam, fabric, rubber material, or Styrofoam. The Electronic Device Placeholder 370 can also be constructed into other various shapes or forms, apart from a octagon shape, comprising such as without limitation, a human or humanoid like figure, alphabet, number, square, circle, heart, clover, star, diamond, oval, trapezoid, pentagon, hexagon, triangle, parallelogram, or rhombus shape(s), or animal shape that are recognizable to children and/or adults.

As seen in FIGS. 4A-4E, the Attachable Door Cover Insert Panels 400 can be optionally coupled, arranged, set, fixed or placed in such that it tracks the shape of the Attachable Door Cover Insert 200 accessory as seen in FIG. 4A. The Attachable Door Cover Insert Panels 400 has a plurality of separable fasteners 210 located on its back surface 460 surface that allows it to be interchangeably attached, mounted, fastened, secured, affixed or joined to the Attachable Door Cover Insert 200 accessory, through the use of the plurality of Door Cover Attachment separable fasteners 210 located on the front side of the Attachable Door Cover Insert 200 accessory as seen in FIGS. 4B, D and E. The Attachable Door Cover Insert Panels 400 has optionally several corners 420 with a front surface 430 to form a generally octagon shaped formation as seen in FIG. 4A. The Attachable Door Cover Insert Panels 400 can also optionally have a plurality of Panel support brackets 260 with separable fasteners 210 on its front surface 430, as seen in FIG. 4B. The plurality of Panel support brackets 260 with separable fasteners 210 on its surface are used to couple, support, hold, fasten, affix, embrace, secure, mount or attach to the Receptacle Stand Inlay Panel Accessories 800 as seen in FIG. 8A.

The Attachable Door Cover Insert Panels 400 can optionally be change, reshape, replaced, exchanged, restructured, rearranged or redesigned to various forms or arrangements as seen in FIGS. 4A-4E. The Attachable Door Cover Insert Panels 400 can be independently or optionally shaped into such as, but not limited to the following Insert Panel 400 Samples, in FIG. 4A, is a front perspective view of Attachable Door Cover Insert Panel 400 displaying a Basketball design 440, in FIG. 4A, is a front perspective assembly view of the Detachable Multi-Functional Housing Compartment 100 receiving an Attachable Door Cover Insert 200 accessory, and displaying a Photo 432 Attachable Door Cover Insert Panel 400 with a plurality of panel support brackets 260 with separable fasteners 210 on the Attachable Door Cover Insert Panel 400. In FIG. 4C is a front perspective view of the Attachable Door Cover Insert 200 and Attachable Door Cover Insert Panel 400 with a flat surface displaying a Greeting Card 434 sample.

As seen in FIG. 4D-E is a front and rear perspective view of the Attachable Door Cover Insert 200 and an Attachable Door Cover Insert Panel 400 displaying a house with a rectangular shape mail box slot cutout 436 opening or cavity through its panel 400. Both FIGS. 4D and 4E are displaying a plurality of separable fasteners 210. FIGS. 4D and 4E also displays is a mail box 435 coupled to the mail box slot cutout 436. FIG. 4E is a rear perspective view of the Attachable Door Cover Insert 200 and Attachable Door Cover Insert Panel 400 displaying a plurality of separable fasteners 210.

Figure 5C:
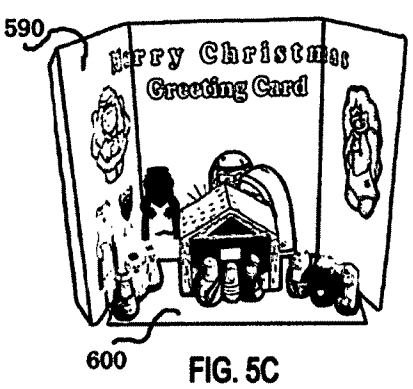
FIG. 5C is a front view of A Housing Compartment Card Insert Accessory displayed as a Greeting Card with Trinkets placed on a Attachable Floorboard Inlay Accessory.
Figure 5A:
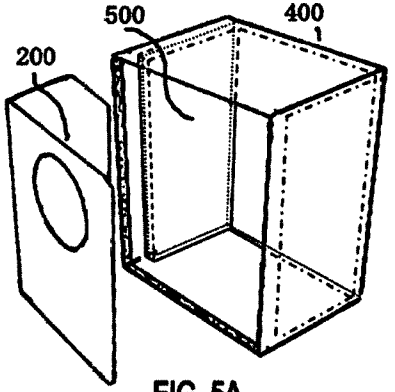
FIG. 5A is a front perspective view of the Detachable Multi-Functional Housing Compartment displaying separable fasteners and a Housing Compartment Card Insert Accessory outlined within its cavity compartment, also an Attachable Door Cover Insert that has a circular shape cut out opening on its flat surface.
Figure 5B:
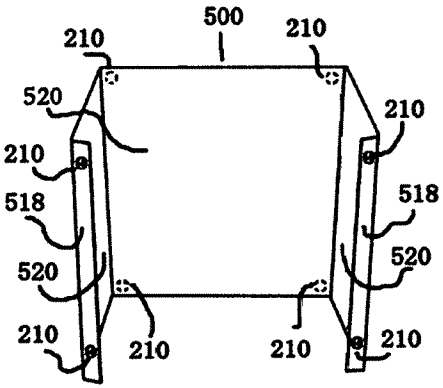
FIG. 5B is a front view of A Housing Compartment Card Insert Accessory comprising a flat surface with a plurality of separable fasteners on its front and rear surfaces, and a plurality of flanges.
Figure 5E:
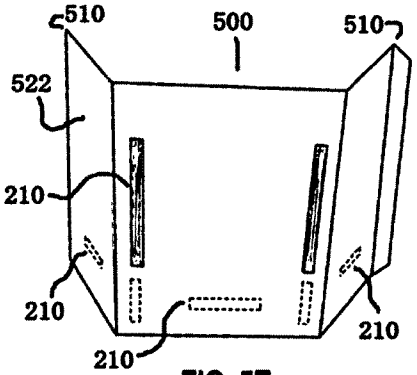
FIG. 5E is a back view of the Housing Compartment Card Insert Accessory displaying back separable fasteners used to connect to an Attachable Door Cover Inserts or Attachable Door Cover Insert Panels, also displayed are outlined separable fasteners used to attach to the separable fasteners of an Attachable Receptacle Stand.
Figure 5D:
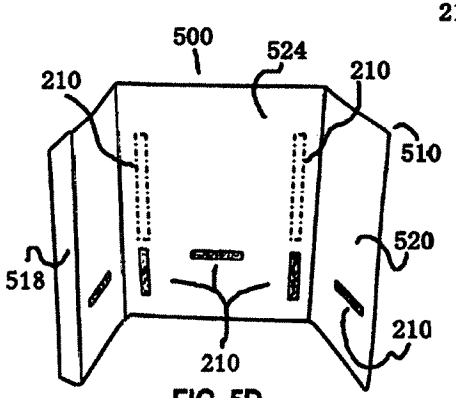
FIG. 5D is a front view of the Housing Compartment Card Insert Accessory displaying front separable fasteners used to connect to an Attachable Receptacle Stand also displayed are outlined separable fasteners used to attach to the separable fasteners of Attachable Door Cover Inserts or Attachable Door Cover Insert Panels.

The Attachable Door Cover Insert Panel 400 can be made of any resilient materials, comprising such as without limitation, wood, cardboard, Styrofoam, acrylic, wood, chipboard, foam, plastic, paper, rubber or metal material. The Attachable Door Cover Insert Panel 400 may also be constructed into other various shapes or have cavity openings on its front surface 430 for toss games, sport games, dollhouses or playhouse designs, arts or crafts designs, diagrams, images, puzzles, shapes or forms. The Attachable Door Cover Insert Panel 400 may also be configured apart from its octagon shape comprising such as without limitation, a dry erase or chalk board, drawing board, alphabet, number, square, circle, heart, clover, star, diamond, oval, trapezoid, pentagon, hexagon, triangle, parallelogram, or rhombus shape, holiday, carnival or party symbol, alphabet, heart, numbers, phrases, photo, pictures, sports icons or figures, entertainers or celebrities or animal shapes that are recognizable to children and/or adults. The Attachable Door Cover Insert Panel 400 may also be place on a different location or section of the Attachable Door Cover Insert 200 accessory As best seen in FIGS. 5A-5E, 7A-7B and 8D, the Housing Compartment Card Insert Accessory 500 is made of any of the following including but not limited to foam, photo paper, cardstock, chipboard, acrylic, cardboard, wood, plastic or vinyl sheets. The Housing Compartment Card Insert Accessory 500 comprises a plurality of flexible flanges 518, several corners 510 with a front surfaces 520 as seen in FIGS. 5B-5E. As seen in FIG. 5A, the Housing Compartment Card Insert Accessory 500 can optionally be formed to a tri-foldable shaped to insert within the detachable multi-functional housing compartment insert assembly's 100 general compartment cavity 180. The Housing Compartment Card Insert Accessory 500 shape can be optionally nested and arranged such that it tracks the shape of the detachable multi-functional housing compartment insert assembly 100 and allows the closure of the Attachable Door Cover Insert 200 over the opening to the detachable multi-functional housing compartment insert assembly 100 which is also seen in FIG. 5A. The Housing Compartment Card Insert Accessory 500 can optionally stand freely, independently, self-reliantly, individually, separately, or alone supporting itself, as seen in FIG. 5B. The Housing Compartment Card Insert Accessory 500 comprises a plurality of separable fasteners 210 on its front surface 520 and rear surfaces 522, a plurality of flexible flanges 518 as seen in FIG. 5B and FIG. 5D. As seen in FIG. 5B, the Housing Compartment Card Insert Accessory 500 may comprise a plurality of optionally separable fasteners 210 on its back rear surface 522 used to couple, fasten, or affixed to a plurality optional of separable fasteners 210 on the rear surface 140 of the detachable multi-functional housing compartment insert assembly's 100 general compartment cavity 180 as seen in FIG. 1A. As seen and outlined in FIG. 5D and FIG. 5E, the Housing Compartment Card Insert Accessory 500 also comprise a plurality of separable fasteners 210 which are used to interchangeably couple, connect, fasten, secure, affix, hold or join to an Attachable Receptacle Stand 700, which is seen in FIGS. 7A-7B and FIG. 8D. As seen in FIG. 5D are outlined a plurality of separable fasteners 210 and in FIG. 5E, the Housing Compartment Card Insert Accessory 500 shows the noticeable plurality of separable fasteners 210 on its rear surface 522. The plurality of separable fasteners 210 as seen in FIG. 5E, are used to optionally couple the Door Cover Attachment's separable fasteners 210 to the Attachable Door Cover Inserts 200, seen in FIG. 2D, or can optionally be coupled, fasten, secure, affix, attach to separable fasteners 210 placed on the front of the Attachable Door Cover Insert Panels 400, figure is not shown. In FIG. 5C, is a front sample view of the Housing Compartment Card Insert Accessory 500 displayed as a Holiday Greeting Card 590 with Toy Trinkets 592 placed on a Attachable Floorboard Inlay Accessory 600

The Housing Compartment Card Insert Accessory 500 is also constructed and configured into various arts and crafts cards, greeting cards, tri-fold dry erase or chalk board, drawing board, diagrams, images, game cards, room backgrounds, dollhouse scenery, wall backgrounds, puzzles, background scenery, activity shapes or forms. Apart from a rectangular shape, it comprises such as without limitation, alphabet, number, square, circle, heart, clover, star, diamond, oval, octagon, trapezoid, pentagon, hexagon, triangle, parallelogram, or rhombus, or animal shape. The Housing Compartment Card Insert Accessory 500 can be made of any resilient materials, comprising such as without limitation, cardboard, acrylic, chipboard, wood, foam, plastic, fabric, Styrofoam, paper, or rubber, canvas, weave, wicker or metal material. The Housing Compartment Card Insert Accessory 500 may also be place in a different place or section of the novelty toy body 1100, inflatable body 900, mascot or costume body 950 cavity 1200.

Figure 6C:
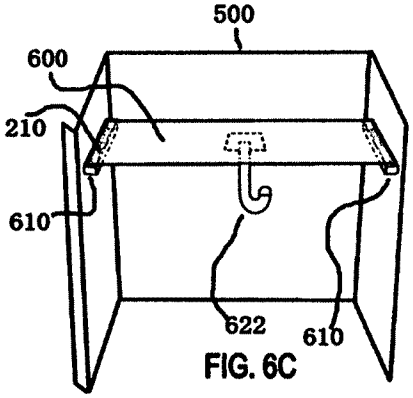
FIG. 6C is a front view of the Housing Compartment Card Insert Accessory displaying a sample girl's jewelry armoire assembly containing hooks and Attachable Floorboard Inlays while being supported by brackets mounted to the walls of the Housing Compartment Card Insert Accessory.
Figure 6E:
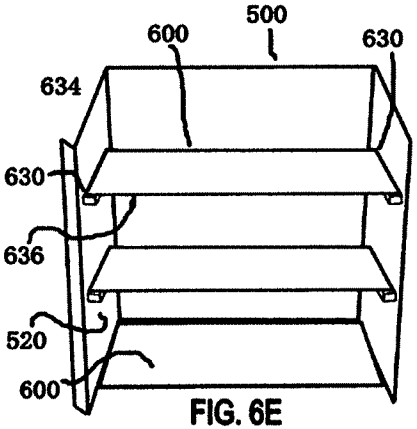
FIG. 6E is a front view of the Housing Compartment Card Insert Accessory displaying several flat surface floorboards with no cutouts being supported by brackets mounted to the walls of the Housing Compartment Card Insert Accessory.
Figure 6B:
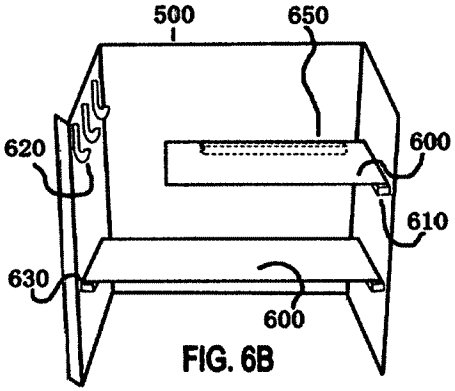
FIG. 6B is a front view of the Housing Compartment Card Insert Accessory displaying a sample plant holder assembly containing a Attachable Floorboard Inlay with a hook attached to it while being supported by brackets mounted to the walls of the Housing Compartment Card Insert Accessory.
Figure 6A:
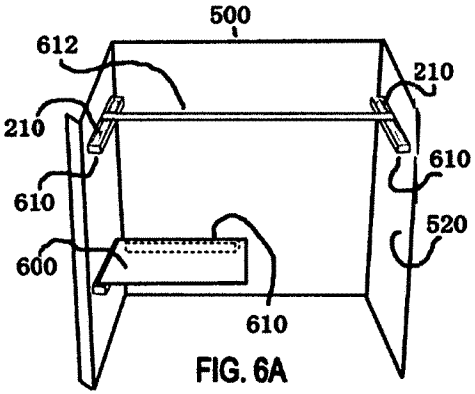
FIG. 6A is a front view of the Housing Compartment Card Insert Accessory displaying a sample closet assembly containing a pole and shelf Attachable Floorboard Inlay being supported by brackets mounted to the walls of the Housing Compartment Card Insert Accessory.
Figure 6D:
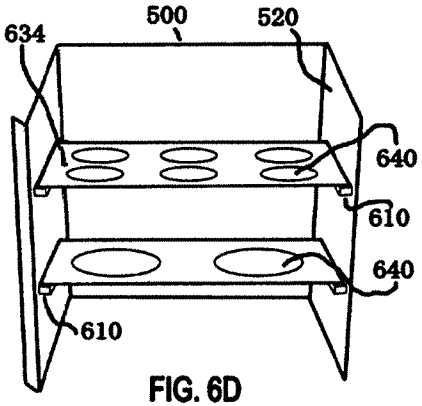
FIG. 6D is a front view of the Housing Compartment Card Insert Accessory displaying a sample cupcake or seed starter assembly containing two Attachable Floorboard Inlay with several circular cutouts ranging in size, the floorboard inlays are being supported by brackets mounted to the walls of the Housing Compartment Card Insert Accessory.

As seen in FIGS. 6A-6E, the Housing Compartment Card Insert Accessory 500 can optionally have a plurality of wall brackets 610 with separable fasteners 210 on its top surface, best seen in FIG. 6A holding a sample Closet Pole 612. The plurality of wall brackets 610 with separable fasteners 210 are coupled, secured, mounted, placed, or optionally permanently positioned or located in variety of areas on the Housing Compartment Card Insert Accessory's 500 front surfaces 520, as seen in FIG. 6A-E. The plurality of wall brackets 610 with separable fasteners 210 are used to hold, support, secure, attach, fasten, join an assortment or a plurality of Attachable Floorboard Inlay Accessories 600 by the use of a plurality of separable fasteners 210, which are located underneath or at the bottom of the Attachable Floorboard Inlay Accessory's 600 bottom surface 636, as best seen in FIG. 6C and FIG. 6E. This allows the Attachable Floorboard Inlay Accessories 600 to be securely placed or fasten within the Housing Compartment Card Insert Accessory's 500 embodiment. The Attachable Floorboard Inlay Accessories 600 as best seen in FIG. 6E, has a plurality of corners 630, and is formed in an elongated rectangular shape with a top surface 634, and a bottom surface 636. As seen in FIG. 6D, it has several optionally cavity openings or holes 640 through its top surface 634 formed within the Attachable Floorboard Inlay Accessory 600. As seen in FIG. 6C, the Attachable Floorboard Inlay Accessories 600 are arranged to optionally share space with hooks 620 that are located on the front surfaces 520 of the Housing Compartment Card Insert Accessory 500. As seen in FIG. 6B is a front view of the Housing Compartment Card Insert Accessory 500 displaying a sample Floorboard plant holder assembly 622 with a hook attached underneath the bottom surface of the Attachable Floorboard Inlay Accessory 600. The Attachable Floorboard Inlay Accessories 600 are supported by a plurality of wall brackets 610 with separable fasteners 210 that are mounted to the front surface 520 of the Housing Compartment Card Insert Accessory 500, walls as seen in FIG. 6B. The Attachable Floorboard Inlay Accessories 600 are arranged to interchangeably or optionally support, hold or secure items such as but not limited to plants, toys, floral arrangement, food items, or miniature novelty items on or within its top surface 634 as seen in FIGS. 11A, 11C and 11F.

The Attachable Floorboard Inlay Accessories 600 can be made of any resilient materials comprising such as without limitation, wood, cardboard, acrylic, marble, metal, tile, chipboard, foam, plastic, fabric, paper, rubber, weave or wicker material. The Attachable Floorboard Inlay Accessories 600 may also be constructed or comprised into other various arts and crafts, diagrams, images, puzzles, shapes or forms, apart from a rectangular shape, such as without limitation, a square, oval, circle, heart, clover, star, octagon or animal shape. The Attachable Floorboard Inlay Accessories 600 comprises of optionally cavity openings or holes 640 through its top surface 634 in the configuration of an alphabet, number, square, circle, heart, clover, star, diamond, oval, octagon, trapezoid, pentagon, hexagon, triangle, parallelogram, or rhombus. The detachable multi-functional housing compartment insert assembly 100 or cavity also comprises a permanent or fixed Attachable Floorboard Inlay Accessories 600.

Figure 7C:
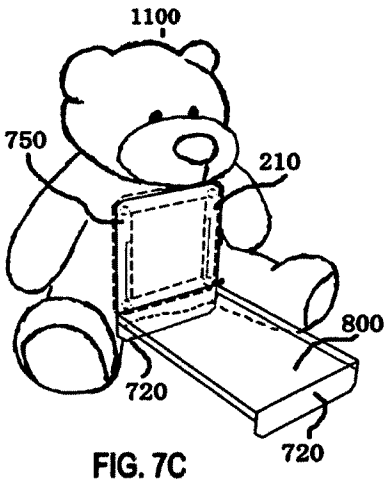
FIG. 7C is a front perspective view of the novelty toy displaying an Attachable Receptacle Stand with a flat surface being coupled, fastened or joined to an outlined Attachable Door Cover Insert.
Figure 7E:
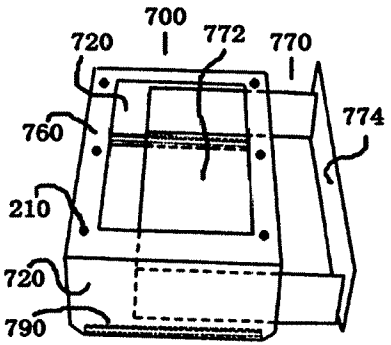
FIG. 7E is a top front view of the Attachable Receptacle Stand displaying an attachable drawer partially inserted underneath it, along with fasteners surrounding the rectangular cutout opening on its horizontal flat surface.
Figure 7B:
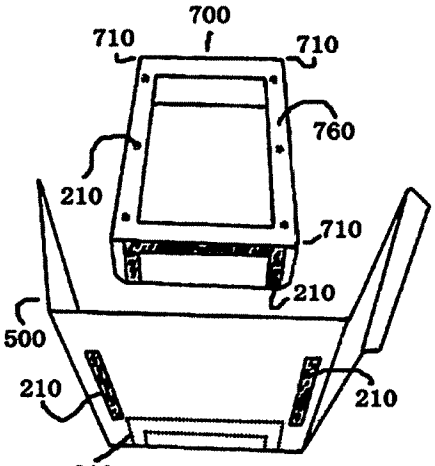
FIG. 7B is a top back view of the Attachable Receptacle Stand with a display of separable fasteners and the Housing Compartment Card Insert Accessory with outlined separable fasteners displayed on its front surface and separable fasteners on its back surface.
Figure 7A:
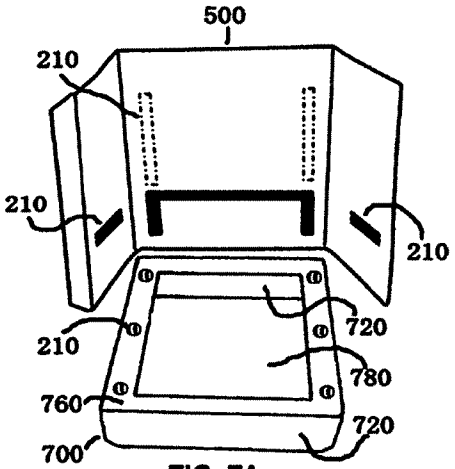
FIG. 7A is a front view of the Attachable Receptacle Stand and Housing Compartment Card Insert Accessory with separable fasteners being displayed on its front surface and separable fasteners outlined on its back surface.
Figure 7D:
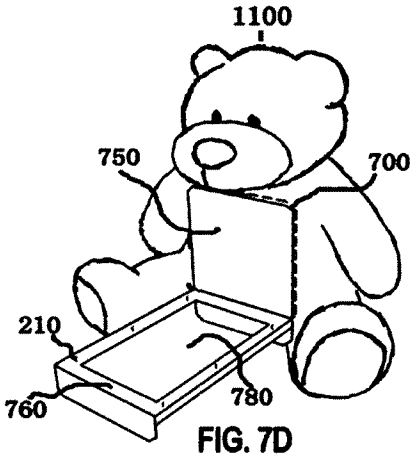
FIG. 7D is a front perspective view of the novelty toy coupled, fastened or joined to an Attachable Receptacle Stand that has a flat surface and a rectangular cutout opening and separable fasteners on its horizontal flat surface.

Referring now to FIGS. 7A-7E, 8B, 8D and 8E the Attachable Receptacle Stand 700 has a plurality of corners 710 with a top surface 760, a bottom surface 764, a plurality of flanges 768 on it opposite sides, a plurality of support legs 720 underneath its top surface 760 to form a generally rectangular boxed shaped formation, as seen in FIGS. 7A-7C and FIG. 7E. The Attachable Receptacle Stand 700 also comprises an optionally Vertical Backboard Stand 750 as seen in FIGS. 7C-7D and 8B. The Attachable Receptacle Stand 700 comprises a generally rectangular cavity opening 780 used to interchangeably receive, support, place, house, affix, fasten or place a variety of Receptacle Stand Inlay Panel Accessories 800 for various learning, arts and crafts, or game play activities or therapeutic settings as seen in FIGS. 7D and 8B. The Receptacle Stand Inlay Panel Accessory 800 games comprises of, but not limited to the following, golf, bean bag toss, putt-putt golf, bowling, or a host of toss activities. As seen in FIG. 7D, a plurality of separable fasteners 210 are around the top surface 760 of the generally rectangular cavity opening 780 to receive a plurality of separable fasteners of the Receptacle Stand Inlay Panel Accessory 800 which are located on the Receptacle Stand Inlay Panel Accessory's 800 bottom surface 850. Also seen in FIGS. 7C and 8B, the Vertical Backboard Stand 750 has a plurality of separable fasteners 210 on its back surface use to couple, fasten, attach, secure and adjoin to the plurality of Attachable Accessory templates as seen in FIG. 12, which comprises but not limited to the Attachable Door Cover Insert 200, Attachable Door Cover Insert Panels 400 and/or the Housing Compartment Card Insert Accessory 500. FIG. 7C shows a permanent Receptacle Stand Inlay Panel Accessory 800 with the Vertical Backboard Stand 750 that has a front surface being attached, adjoined, affixed, bonded, molded or formed has one fixture. As seen in FIG. 7B, the Attachable Receptacle Stand 700, without the optionally Vertical Backboard Stand 750 is positioned to be coupled, connected, attached, or fastened to a Housing Compartment Card Insert Accessory 500 by use of their plurality of separable fasteners 210. In FIG. 8B, the Receptacle Stand Inlay Panel Accessory 800, is optionally and interchangeably coupled, attached, affixed, fasten, secured or connected to the Attachable Receptacle Stand 700 through the plurality of Receptacle Stand separable fasteners 210 being coupled or fastened to the Receptacle Stand Inlay Panel Accessory's 800 separable fasteners 210. The Attachable Receptacle Stand 700 can also function as a standalone source if chosen or preferred by user also seen in FIGS. 7A-7B and FIG. 7E. Another function of the Attachable Receptacle Stand 700, is to allow the Receptacle Stand Inlay Panel Accessories 800 to be interchangeably supported, secured, fastened, joined, affixed or mounted to the Attachable Receptacle Stand's 700 plurality of separable fasteners 210 which are shown in FIG. 8D. As seen in FIGS. 7A-7B, 7D, 8B and 8D, the plurality of Attachable Receptacle Stand 700 separable fasteners 210 are located around the top surface 760 of its generally rectangular cavity opening 780 to receive the plurality of Inlay Panel separable fasteners 210. As seen in FIG. 7E, the Attachable Receptacle Stand 700 has a plurality of support legs 720 underneath its top surface 760 forming an opening to receive or house a Receptacle Stand Compartment Drawer 770. The Receptacle Stand Compartment Drawer 770 glides along a plurality of Receptacle Stand Compartment Drawer Slides Track 790. The Receptacle Stand Compartment Drawer 770 comprises a horizontal flat planar surface bottom 772 having a plurality of upstanding flanges 774 around its perimeter forming an open tray or box like shape.

The Attachable Receptacle Stand 700 is designed to couple, hold, fasten, secure, house, conceal, attach, adjoin, or place a variety of interchangeable attachable accessory template inserts on its top surface 760. Other traditional and conventional novelty items include but not limited to trinkets, figurines, dolls or dollhouse accessories, terrariums, sandbox or sand tray, diorama, plants, greenhouse or garden, bug or insect lore, fish, pet or reptile habitat or aquarium, golf, toss games, cupcakes holder, games, school supplies, arts and crafts, jewelry, clothing, toys, edible foods for humans or pets, photo album, digital camera, a jewelry box and/or a box of chocolates. To show each novelty item is prohibitive, however as seen in FIGS. 7A-7D are samples being displayed.

The Attachable Receptacle Stand 700 and the Receptacle Stand Compartment Drawer 770 is made of any resilient materials comprising such as without limitation, chipboard, and wood, cardboard, plastic, fabric, rubber, and weave or wicker, metal or acrylic, or Styrofoam material. The Attachable Receptacle Stand 700 and Receptacle Stand Compartment Drawer 770 may also be constructed into other various shapes or forms, apart from a rectangular shape, comprising such as without limitation, an alphabet, number, square, circle, heart, clover, star, diamond, oval, octagon, trapezoid, pentagon, hexagon, triangle, parallelogram, or rhombus, structure, personalized or customized face, humanoid, celebrity, sport figure or animal shape, photo image, pictures, arts or crafts, sports icons or figures, entertainers, holiday image, carnival character, party personality, special or romantic shapes. The Attachable Receptacle Stand 700 is also shaped in the form of a bed with a mattress and attachable headboard or footboard as seen in FIG. 8B. It is also shape, form or designed as a chalk or dry erase board, a writing, drawing, trace light sketching or painting desktop surface. The Attachable Receptacle Stand 700 also features an optionally variety of openings on its top surface 760 to comprise some of the following, but not limited to golf, hockey, soccer, football, baseball, basketball, carnival and toss games, and a variety of other activity games. The Attachable Receptacle Stand 700 can also be used to interchangeably hold, secure, support or house a sandbox or sand tray, figurines, dolls or dollhouse accessories, containers, greenhouse or garden, planters, vases or trays just to name a few.

Referring to FIGS. 8A-8E, The Receptacle Stand Inlay Panel Accessories 800 as seen in FIG. 8A can be optionally arranged, set, fixed or placed in such that it tracks the shape of the Attachable Receptacle Stand 700 which is outlined in FIGS. 8B and 8D. Also seen in FIGS. 8A and 8C, the Receptacle Stand Inlay Panel Accessory's 800 has optionally several corners 830 comprising a top surface 860 and a bottom surface 850 to form a generally rectangular shaped formation. The Receptacle Stand Inlay Panel Accessories 800 has a plurality of optionally separable fasteners 210 on its top and bottom surfaces as seen in FIGS. 8A, 8B and 8E, coupling to another Receptacle Stand Inlay Panel Accessory 800. The separable fasteners 210 located the Receptacle Stand Inlay Panel Accessory's 800 bottom surface 850, as seen in FIG. 8A, allows the Receptacle Stand Inlay Panel Accessory 800 to be interchangeably coupled, attached, mounted, fastened, secured, affixed or joined to the Attachable Receptacle Stand 700, as seen in FIG. 8D.

As shown in FIG. 8B, is a perspective view displaying a doll and pillow 870 place on the top surface 860 of the Receptacle Stand Inlay Panel Accessory 800 which being coupled, attached or joined to the outlined Attachable Receptacle Stand 700. The Receptacle Stand Inlay Panel Accessories 800 can also be optionally coupled, attached, combined, joined or permanently placed together as one piece to an Attachable Floorboard Inlay Accessory 600 to pivotally form, construct a slope, incline or create an access ramp, as seen in FIG. 8E. Also seen in FIG. 8E, the Receptacle Stand Inlay Panel Accessories 800 having an optionally rectangular cavity opening 840 through the top surface 860 for optionally placement of a plurality of inlay panel accessories 800 to be placed, secured, supported, affixed, fastened, adjoined, attached, clasped to its Inlay panel separable fasteners 210.

The Attachable Door Cover Insert Panels 400 can also optionally have a plurality of panel support brackets 260 with separable fasteners 210 on its front surface, as seen in FIGS. 4B and 8C. The support brackets 260 with separable fasteners 210 are used to support, hold, fasten, affixed, embraced, secured, mounted, attached or couple to the Receptacle Stand Inlay Panel Accessory's 800 Inlay panel separable fasteners 210, as seen in FIG. 8A and FIG. 8C. In FIG. 8D, two foldable Inlay Panels 890 are optionally coupled, attached combined, joined or permanently placed together as one, to pivotally form, construct a slope, incline or an access ramp. Also displayed in FIG. 8D, is the Attachable Receptacle Stand 700 being attach to the Housing Compartment Card Insert Accessory's 500 front wall separable fasteners 210. Furthermore, in FIG. 8D, the Receptacle Stand Inlay Panel Accessories 800 shows an optionally cavity opening shape 844 placed through its top surface 860. In FIG. 8C, the Receptacle Stand Inlay Panel Accessories 800 is attached to support brackets 260 with separable fasteners 210 which are affixed, joined, or attached to an Attachable Door Cover Insert Panel 400 Accessory, thus forming a writing surface.

The Receptacle Stand Inlay Panel Accessories 800 are designed in assorted designs for various settings, activities, functions or occasions including but not limited to, therapy or therapeutic settings, promotional activities, arts and crafts, religious functions, fairs, traditional and conventional learning games and activities, sporting templates for schools, family, recreational, political, leisure, educational, social and cultural activities or gatherings. The Receptacle Stand Inlay Panel Accessories 800 can optionally be used for placement of other Receptacle Stand Inlay Panel Accessories 800 thus allowing appropriate, suitable and fitting items such as golf balls, hockey pucks, soccer balls, bean bags or any other rolling object or balls to enter into the detachable multi-functional housing compartment insert assembly's 100 general compartment cavity 180.

The Receptacle Stand Inlay Panel Accessories 800 can be made of any resilient materials comprising such as without limitation, chipboard, wood, cardboard, plastic, fabric, rubber, and weave or wicker, metal, translucent or acrylic, or Styrofoam material. Receptacle Stand Inlay Panel Accessories 800 may also be constructed into other various shapes or forms, apart from a rectangular shape, comprising such as without limitation, an alphabet, number, square, circle, heart, clover, star, diamond, oval, octagon, trapezoid, pentagon, hexagon, triangle, parallelogram, or rhombus, a structure, personalized or customized face, humanoid, celebrity, sport figure or animal shape, photo image, pictures, arts or crafts, sports icons or figures, entertainers, holiday image, carnival character, party personality, special or romantic shapes. Receptacle Stand Inlay Panel Accessories 800 is also shaped in the form of a bed mattress. It is also shape, form or designed as a chalk or dry erase board, a writing, drawing, translucent trace light sketching or painting desktop surface. The Receptacle Stand Inlay Panel Accessories 800 also features an optionally plurality or variety of cavity opening shapes 844 placed in different locations on its top surface 860 for allowing appropriate, suitable and fitting items such as golf balls, hockey pucks, mini soccer balls, mini bowling balls, mini baseball, mini football, bean bags or any other rolling object or balls for entry through the cavity opening shapes 844. These cavity opening shapes 844 are optionally shaped in the following designs or configurations without limitation, an alphabet, number, square, circle, heart, clover, star, diamond, oval, octagon, trapezoid, pentagon, hexagon, triangle, parallelogram, or rhombus shape for the following, but not limited to golf, hockey, soccer, football, baseball, basketball, carnival or toss games, and a variety of other activity games. It can also be used to hold, secure, support containers, figurines, dolls or dollhouse accessories, greenhouse or garden, planters, vases or trays just to name a few.

Figure 10B:
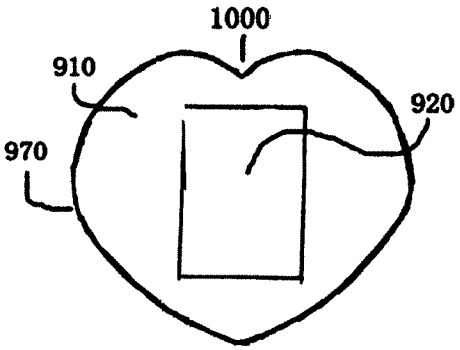
FIG. 10B is a front view of the detachable shape template accessory displaying the shape of a heart with an opening to go over the detachable multi-functional housing compartment insert assembly.
Figure 10C:
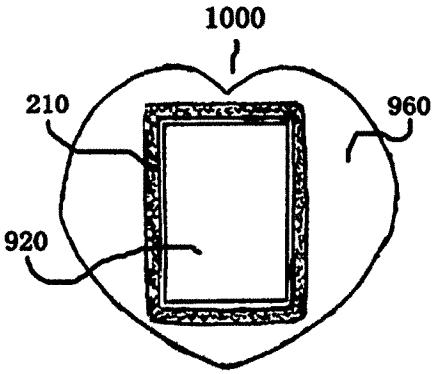
FIG. 10C is a rear view of the detachable shape template accessory displaying the shape of a heart with detachable shape template fasteners used to secure, affix, attach or fasten to the detachable shape template body fasteners located on the novelty toy, mascot or costume embodiment.
Figure 10A:
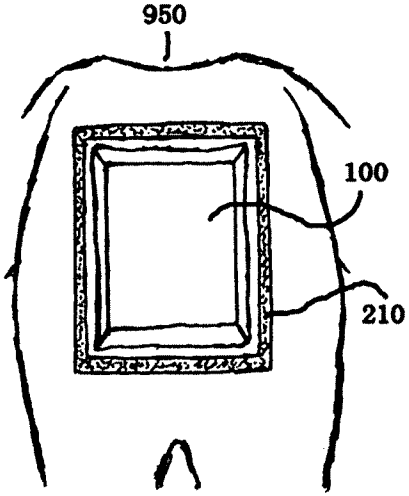
FIG. 10A is a front view of a novelty toy body displaying the detachable multi-functional housing compartment insert assembly within its body cavity and detachable shape template body fasteners on the front of the novelty toy's body.

Referring to FIGS. 10A-10D, the detachable multi-functional housing compartment insert assembly 100 also comprises a Attachable Shape Template Accessory 1000 that can be interchangeably attached, secured, mounted, fastened, secured, clipped, affixed, joined to the novelty toy body 1100, inflatable body 900, mascot or costume body 950 cavity 1200. The Attachable Shape Template Accessory 1000 having a front surface 910 with an opening cavity 920 with smooth outer edges 970 in the optionally form of a heart, as seen in FIGS. 10B and 10C. The Attachable Shape Template Accessory 1000 also comprises separable fasteners 210 on its back surface 960 as seen in FIG. 10C, which are used to interchangeably couple, attach, mount, fasten, secure, clip, affix, join to the separable fasteners 210, as seen in FIG. 10A. The separable fasteners 210 are securely affixed or arranged whereas it is strong enough not to separate, detached or come apart from the novelty toy body 1100, inflatable body 900, mascot or costume body 950 when coupled, connected or joined to the shape template separable fasteners 210, as seen in FIG. 10D. The Attachable Shape Template Accessory 1000 can be placed, mounted or straddled over the opening of the detachable multi-functional housing compartment insert assembly 100 to allow the Attachable Door Cover Insert 200 to be open and/or closed, as seen in FIG. 10D. Also seen in FIG. 10D, is the embodiment of a mascot or costume 950 displaying the Attachable Shape Template Accessory 1000 coupled, mounted, secured, connected or joined by a plurality of shape template body separable fasteners 210 and a plurality of shape template separable fasteners 210.

The detachable shape template 900 may be constructed into other shapes or forms apart from the figures listed in FIGS. 10B-10D, comprising such as without limitation a holiday, carnival or party symbol, special or romantic shapes, alphabet, heart, numbers, phrases, photo, pictures, arts or crafts, sports icons or figures, entertainers or celebrities. Other various shapes or forms of the Attachable Shape Template Accessory 1000 apart from a heart shape, comprising includes such as without limitation, a float, arts and crafts, diagrams, images, puzzles, shape carriage, vehicle, stage, aquarium, human or humanoid like figure, alphabet, number, square, circle, heart, clover, star, diamond, oval, octagon, trapezoid, pentagon, hexagon, triangle, parallelogram, rhombus, or animal shape that are recognizable to children and/or adults. The Attachable Shape Template Accessory's 1000 opening cavity 920 may also be configured into the following cavity openings to such as, but not limited to an alphabet, number, rectangle, square, circle, heart, clover, star, diamond, oval, octagon, trapezoid, pentagon, hexagon, triangle, parallelogram or rhombus opening. The Attachable Shape Template Accessory 1000 may also be place in a different place or section of the novelty toy body 1100, inflatable body 900, mascot or costume body 950 cavity 1200.

The Attachable Shape Template Accessory 1000 can also be designed into various therapy or therapeutic games or learning activity templates including but not limited to, game templates for licensed or certified professional therapy or counseling in a therapeutic setting, Inquiry Based Learning, Connected Learning, educational or learning development settings for adults, children or individuals with special needs, arts and crafts activities, fund raising, promotional occasions, holiday or religious games, fairs, Mardi Gras, festivals, traditional and conventional learning games and activities such as but not limited to, "hand toss", "bingo", "flash cards", "tic-tac-toe", "pin the tail on the . . . ", or various sporting templates including but not limited to, football, baseball, basketball, cricket, golf, bowling, hockey, dartboard and/or soccer just to name a few. Other designs included are chalk or white board surfaces, clear or printed transparencies, embellishments or magnetic crafts accessories attached to its surface, paintings, drawings for family and schools, recreational, political, social and cultural activities imprinted on its surface. The Attachable Shape Template Accessory 1000 can also be in the form of a bed headboard or footboard with an opening on its flat surface to allow a detachable multi-functional housing compartment insert assembly 100 with a plurality of Attachable Accessory templates as seen in FIG. 12, comprising of an Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, and Receptacle Stand Inlay Panel Accessory 800 to be optionally coupled, fastened, secured, housed, concealed, stored or attached by concealed compartment separable fasteners 210.

The Attachable Shape Template Accessory 1000 or cavity can also be made of any resilient materials, comprising such as without limitation, wood, cardboard, acrylic, transparent or translucent material, chipboard, foam, plastic, paper, construction paper, adhesive backed materials such as foam, dry erase, glossy, matte or photo paper, Styrofoam, fabric, rubber, and weave or wicker material, just to name a few.

The detachable multi-functional housing compartment insert assembly 100 is arranged to be removable or optionally permanently housed or concealed in either/or a novelty toy body 1100, inflatable body 900, mascot or costume body 950 cavity 1200. On the other hand, the detachable multi-functional housing compartment insert assembly 100 with a plurality of Attachable Accessory templates as seen in FIG. 12, comprising of an Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 can be used as a carnival fair or party event, floral or gift delivery service, game, therapy or therapeutic setting, Inquiry Based Learning, Connected Learning, educational or learning activity, arts and crafts, toss or board game accessory companion while housed into a novelty toy body 1100, inflatable body 900, mascot or costume body 950.

The user first determines the desired use or function of the present invention, such as a gift basket or floral arrangement, placement of figurines, dolls or dollhouse accessories, sandbox or sand tray, greenhouse or garden, reptile inhabitant, bug or insect lore, therapeutic or therapy play, educational development or learning setting, game or leisure play toy. The user chooses the novelty toy body 1100, inflatable body 900, mascot or costume body 950 to place or store a Rose Floral Arrangement 1120 presentation, as seen in FIG. 11B inside of the multi-functional housing compartment insert assembly's 100 general compartment cavity 180. Second, the user gathers the preferred attachment accessories to begin preparing for the assembling of the multi-functional housing compartment insert assembly 100. The user selects the following attachments to complete the Rose Floral Arrangement 1120, which comprises the Attachable Door Cover Insert 200, Attachable Screen Protector Door Cover Insert 300, Attachable Door Cover Insert Panel 400, and a Housing Compartment Card Insert Accessory 500. The user now prepares a greeting card background, scenery or backdrop with the Housing Compartment Card Insert Accessory 500, to place inside of the multi-functional housing compartment insert assembly's 100 general compartment cavity 180. Once the Housing Compartment Card Insert Accessory's 500 greeting card is placed, stored or secured inside of the general compartment cavity 180, the user takes an Attachable Screen Protector Door Cover Insert 300 accessory and insert its Pivot Arm 270 into the multi-functional housing compartment insert assembly's 100, Pivot Arm cavity slot 130. The Attachable Screen Protector Door Cover Insert 300 allows viewing of the Floral Arrangement 1120 while placed or stored inside of the multi-functional housing compartment insert assembly 100. Next, the user prepares the poem using an Attachable Door Cover Insert Panel 400 which the user optionally places, fastens, or attaches to an Attachable Door Cover Insert 200. The user will have the option to close or leave open the Attachable Screen Protector Door Cover Insert 300 accessory, pending on how full the detachable multi-functional housing compartment insert assembly 100 is filled.

The user can optional use a plurality of Attachable Accessory templates as seen in FIG. 12, comprising of an Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 that the present invention provides in its detailed description of the invention. The detachable multi-functional housing compartment insert assembly 100 with its plurality of Attachable Accessory Templates comprising of Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 can be also used for, but not limited to a greenhouse or garden, placement of figurines, dolls or dollhouse accessories, sandbox or sand tray, bug or insect lore, therapeutic or therapy play, educational learning setting, game or leisure play toy.

Once the user is finished playing with the novelty toy body 1100, inflatable body 900, mascot or costume body 950, the detachable multi-functional housing compartment insert assembly 100 with the selected plurality of Attachable Accessory Templates comprising of the Attachable Door Cover Insert 200, Attachable Door Cover Shelf Accessory 290, Attachable Screen Protector Door Cover Insert 300, Attachable Screen Protector Door Cover Insert 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 can be optionally unassembled. If desired, the detachable multi-functional housing compartment insert assembly 100 be optionally removed from or permanently secured within the novelty toy body 1100, inflatable body 900, mascot or costume body 950 embodiment. The Attachable Accessory Templates comprising of Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 can be optionally taken out, separated or leaving it in to use or play at a later time. The multi-functional housing compartment insert assembly 100, can also be optionally permanently secured or attached within the novelty toy body 1100, inflatable body 900, mascot or costume body 950 embodiment.

The detachable multi-functional housing compartment insert assembly 100 with its plurality of Attachable Accessory templates comprising of Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 is constructed and arranged to package, store, house, hold, maintain and secure such as but not limited to the placement of figurines, dolls or dollhouse accessories, gift baskets, floral arrangements, edible foods, novelty items, arts and crafts, photos, toys, keepsakes, letters, paintings, sandbox or sand tray, greenhouse or garden, aquariums, reptile inhabitants, bug or insect lore, while coupled, fastened or housed in a novelty toy body 1100, inflatable body 900, mascot or costume body 950 embodiment.

As can be appreciated, that the multi-functional housing compartment insert assembly's 100 Attachable Accessory templates comprising of Attachable Door Cover Insert 200, Attachable Door Cover Shelf Accessory 290, Attachable Screen Protector Door Cover Insert 300, Electronic Device Placeholder 370, Attachable Door Cover Insert Panel 400, Housing Compartment Card Insert Accessory 500, Attachable Floorboard Inlay Accessory 600, Attachable Receptacle Stand 700, Vertical Backboard Stand 750, Receptacle Stand Compartment Drawer 770, Receptacle Stand Inlay Panel Accessory 800, and Attachable Shape Template Accessory 1000 can be removed from the detachable multi-functional housing compartment insert assembly 100 and optionally or selectively used separately or in combination for a variety, different or multiplicity of settings, and/or placed back inside independently if desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the construction and operation shown and described accordingly. All suitable modifications and equivalents may be supported within the scope of the invention.

What is claimed is:

1. An apparatus comprising:

a body comprising:

an outer covering; and a body cavity formed in the body, the body cavity including a cavity opening into the body cavity, a top surface, a bottom surface, a first side surface, a second side surface and a rear surface;

internal fasteners within the body cavity;

an attachable inlay panel accessory having a panel with corners;

a plurality of separable fasteners;

a stand having a top surface having a first side and a second side opposite the first side and a first support leg coupled to the first side and a second support leg coupled to the second side, the top surface of the stand having a stand opening formed therein and the attachable inlay panel accessory being selectively attachable to the top surface of the stand using the plurality of separable fasteners wherein the first side of the stand is configured so that a portion of the stand fits within the body cavity and is selectively attached in the body cavity, and wherein the first support leg comprises a first track and the second support leg comprises a second track; and a stand compartment drawer configured to slide along under the top surface of the stand and along the first track and the second track, the drawer having a bottom floor and a plurality of upstanding flanges around its perimeter forming an open tray being accessible through the stand opening.

2. The apparatus of claim 1, wherein the body comprises one of an inflatable body, a mascot body and a costume body.

3. The apparatus of claim 1, wherein the outer covering is made from a material comprising one of vinyl, faux fur, fabric shell with filling, foamed rubber, polyurethane, and plastic.

4. The apparatus of claim 1, wherein the body is contoured to form one of an animal shaped body, a humanoid body, and a toy character body.

5. The apparatus of claim 1, wherein the panel being a first panel of a plurality of interchangeable panels; and wherein the plurality of interchangeable panels relate to games.

6. The apparatus of claim 1, wherein:

the first support leg includes a top side perpendicularly coupled along a length of the first side and a bottom side having the first track coupled thereto; and the second support leg includes a top side perpendicularly coupled along a length of the second side and a bottom side having the second track coupled thereto.

7. The apparatus of claim 1, wherein the attachable inlay panel accessory configured to attach to the top surface, via the plurality of separable fasteners, to cover the stand opening.

8. The apparatus of claim 1, further comprising a closet assembly including a pole configured to be selectively inserted and attached in the body cavity and wherein the stand and the panel form a doll bed.

9. The apparatus of claim 1, wherein:

the stand has a width and a length; and the body cavity is dimensioned to receive the width of the stand such that the length of the stand extends out from the body cavity and is supported by the second support leg.

10. An apparatus comprising:

a body comprising:

an outer covering; and a body cavity formed in the body, the body cavity including a cavity opening into the body cavity, a top surface, a bottom surface, first side surface, second side surface and a rear surface;

internal fasteners within the body cavity;

an attachable inlay panel accessory having a panel with corners;

a plurality of separable fasteners;

a stand having a top surface having a first side and a second side opposite the first side and a first support leg coupled to the first side and a second support leg coupled to the second side, the top surface having a stand opening formed therein and the attachable inlay panel accessory being selectively attachable to the stand using the plurality of separable fasteners wherein the first side of the stand configured so that a portion of the stand fits within the body cavity and is selectively attached in the body cavity;

a first track coupled to the first support leg;

a second track coupled to the second support leg; and a stand compartment drawer configured to slide along under the top surface and along the first track and the second track, the drawer having a bottom floor and a plurality of upstanding flanges around its perimeter forming an open tray being accessible through the stand opening, wherein the stand has a width and a length; and wherein the body cavity being dimensioned to receive the width of the stand such that length of the stand extends out from the body cavity and supported by the second support leg.

11. The apparatus of claim 10, wherein:

the body is contoured to form one of an animal shaped body, humanoid body and a toy character body; and the outer covering is made from a material comprising one of vinyl, faux fur, fabric shell with filling, foamed rubber, polyurethane, or plastic.

12. The apparatus of claim 10, wherein the panel being a first panel of a plurality of interchangeable panels; and wherein the plurality of interchangeable panels relate to games.

13. The apparatus of claim 10, wherein:

the first support leg includes a top side perpendicularly coupled along a length of the first side and a bottom side having the first track coupled thereto; and the second support leg includes a top side perpendicularly coupled along a length of the second side and a bottom side having the second track coupled thereto.

14. The apparatus of claim 10, wherein:

the panel is a first panel;

the attachable inlay panel accessory configured to attach to the top surface, via the plurality of separable fasteners, to cover the stand opening; and the attachable inlay panel accessory comprises a hole overlapping the stand opening in the top surface of the stand.

15. The apparatus of claim 14, wherein:

the hole is configured to receive an item tossed in the hole while the stand is inserted in the body cavity; and the attachable inlay panel accessory comprises a second panel coupled to the first panel along the second side and constructed to form a sloped surface relative to the first panel.

16. The apparatus of claim 10, further comprising a closet assembly including a pole configured to be selectively inserted and attached in the body cavity and wherein the stand and the panel form a doll bed.

17. An apparatus comprising:

a body comprising:

an outer covering; and a body cavity formed in the body, the body cavity including a cavity opening into the body cavity, a top surface, a bottom surface, a first side surface, a second side surface and a rear surface;

internal fasteners within the body cavity;

an attachable inlay panel accessory having a first panel with corners;

a plurality of separable fasteners; and a stand having a top surface having a first side and a second side opposite the first side and a first support leg coupled to the first side and a second support leg coupled to the second side, the top surface of the stand having a stand opening formed therein and the attachable inlay panel accessory being selectively attachable to the top surface of the stand using the plurality of separable fasteners wherein the first side of the stand is configured so that a portion of the stand fits within the body cavity and is selectively attached in the body cavity, wherein:

the attachable inlay panel accessory comprises a hole being configured to overlap the stand opening in the top surface of the stand and being configured to receive an item tossed in the hole while the stand is inserted in the body cavity; and the attachable inlay panel accessory comprises a second panel coupled to the first panel along the second side and constructed to form a sloped surface relative to the first panel.

* * * * *